US006005334A

United States Patent [19]

Mitome et al.

[11] Patent Number: 6,005,334

[45] Date of Patent: Dec. 21, 1999

[54] ELECTRON-EMITTING APPARATUS HAVING A PERIODICAL ELECTRON-EMITTING REGION

[75] Inventors: Masanori Mitome, Yokohama; Masahiro Okuda, Zama; Toshiaki Aiba, Fujisawa; Shigeki Matsutani, Sagamihara; Kazuhiro Takada; Akira Asai, both of Atsugi, all of Japan

[73] Assignee: Canon Kabushiki Kaisha, Tokyo, Japan

[21] Appl. No.: 08/845,770

[22] Filed: Apr. 28, 1997

[30] Foreign Application Priority Data

Apr. 30, 1996 [JP] Japan ..... 8-109351

[51] Int. Cl.[6] ..... H01J 1/30

[52] U.S. Cl. ..... 313/309; 313/310; 313/496; 313/355

[58] Field of Search ..... 313/309, 310, 313/336, 351, 346 R, 346 DC, 495, 496, 497

[56] References Cited

U.S. PATENT DOCUMENTS

| | | | |
|---|---|---|---|
| 4,954,744 | 9/1990 | Suzuki et al. | 313/336 |
| 5,155,416 | 10/1992 | Suzuki et al. | 313/366 |
| 5,525,861 | 6/1996 | Banno et al. | 313/495 |
| 5,528,099 | 6/1996 | Xie et al. | 313/309 |
| 5,594,296 | 1/1997 | Mitsutake et al. | 313/309 |
| 5,679,960 | 10/1997 | Akama | 257/10 |
| 5,838,097 | 11/1998 | Kasanuki et al. | 313/495 |
| 5,847,495 | 12/1998 | Yamanobe et al. | 313/310 |

FOREIGN PATENT DOCUMENTS

| | | |
|---|---|---|
| 0 665 571 | 8/1985 | European Pat. Off. . |
| 0 301 545 | 2/1989 | European Pat. Off. . |
| 0 660 357 | 6/1995 | European Pat. Off. . |
| 1-311532 | 12/1989 | Japan . |
| 1-311533 | 12/1989 | Japan . |
| 1-311534 | 12/1989 | Japan . |
| 7-235255 | 9/1995 | Japan . |

*Primary Examiner*—Vip Patel
*Assistant Examiner*—Matthew J. Gerike
*Attorney, Agent, or Firm*—Fitzpatrick, Cella, Harper & Scinto

[57] ABSTRACT

An electron-emitting apparatus is constituted by an electron-emitting device having an electroconductive film including electron-emitting portions, and an electrode for attracting electrons. An electrically insulated elongated region is formed in the electroconductive film to divide the film into a higher potential side and a lower potential side. The insulated region has a substantially periodical shape formed of portions projecting to the higher potential side and portions projecting to the lower potential side. Continuous electron-emitting portions are present at at least part of the portion projecting to the higher potential side in one period of the insulated region.

10 Claims, 28 Drawing Sheets

31
32

36

31
32

40

ELECTRON-EMITTING APPARATUS HAVING A PERIODICAL ELECTRON-EMITTING REGION

BACKGROUND OF THE INVENTION

1. Field of the Invention

The present invention relates to an electron source and an image-forming apparatus such as a display apparatus as an application of the electron source and, more particularly, to a surface-conduction electron-emitting device having a new structure, an electron-emitting apparatus or an electron source using the surface-conduction electron-emitting device, and an image-forming apparatus such as a display apparatus as an application of the electron source.

2. Related Background Art

Electron-emitting apparatuses using surface-conduction electron-emitting devices have simple structures, and can be easily manufactured and driven by a driving voltage of several to several tens V. Recently, the electron-emitting apparatuses as flat-type display apparatuses have been developed and researched.

The structures and manufacturing methods for the surface-conduction electron-emitting device and the electron-emitting apparatus using the same have been described in detail in, e.g., Japanese Patent Application Laid-Open No. 7-235255. This prior art will be briefly described below.

FIGS. 1A and 1B are schematic views of a conventional surface-conduction electron-emitting device. FIG. 1A is a plan view of the device, and FIG. 1B is a side view of the device. The device includes a substrate 1, a positive device electrode 2, and a negative device electrode 3 and is connected to a power supply (not shown). Electroconductive films 5004 and 5005 are electrically connected to the positive device electrode 2 and the negative device electrode 3, respectively. The thicknesses of the electrodes 2 and 3 are several tens nm to several $\mu$m. The thicknesses of the electroconductive films 5004 and 5005 are about 1 nm to several tens nm. A fissure 5006 almost electrically disconnects the electroconductive film 5004 from the electroconductive film 5005. The characteristic features of the fissure will be described together with the manufacturing process. After the device is formed, electrons are scattered and emitted from a portion near the distal end portion of the electroconductive film on the positive device electrode side of the fissure 5006.

An electron-emitting apparatus using the surface-conduction electron-emitting device will be described below with reference to FIG. 2.

FIG. 2 is a schematic view showing the electron-emitting apparatus using the surface-conduction electron-emitting device having the structure shown in FIGS. 1A and 1B.

This apparatus includes a power supply 10 for applying a device voltage $V_f$ to the device, an ammeter 11 for measuring a device current $I_f$ flowing across the device electrodes 2 and 3, an attracting electrode 12 for capturing electrons emitted from the electron-emitting portion of the device, a high-voltage power supply 13 for applying a voltage $V_a$ to the attracting electrode 12, and an ammeter 14 for measuring an emission current $I_e$ generated by electrons emitted from the surface-conduction electron-emitting device and arriving at the attracting electrode. Additionally, a mesh electrode or phosphor plate is attached to the attracting electrode 12 to measure the distribution of electron arrival positions, as needed. To emit electrons, the power supply 10 is connected to the device electrodes 2 and 3, and the power supply 13 is connected to the electron-emitting device and the attracting electrode 12. To measure the device current $I_f$ and the emission current $I_e$, the ammeters 11 and 14 are connected, as shown in FIG. 2.

The surface-conduction electron-emitting device and the attracting electrode are set in a vacuum vessel 16, as shown in FIG. 2, such that the voltages applied to the device and the electrode can be controlled outside the vacuum vessel. An exhaust pump 15 is constituted by a normal high-vacuum exhaust system comprising a turbo pump and a rotary pump, and an ultra high-vacuum exhaust system comprising an ion pump. The entire vacuum vessel 16 and the electron-emitting device substrate can be heated by a heater (not shown).

The device voltage $V_f$ can change within the range of about zero to several tens V, and the voltage $V_a$ of the attracting electrode can change within the range of zero to several kV. A distance H between the attracting electrode and the electron-emitting device is set on the order of several mm.

A method of manufacturing the surface-conduction electron-emitting device will be described below with reference to FIGS. 3A to 3C.

Step-a

A silicon oxide film having a thickness of about 0.5 $\mu$m is formed on a cleaned soda-lime glass by sputtering, and a photoresist pattern (negative pattern) of the device electrodes 2 and 3 is formed on the substrate 1. A Ti film having a thickness of, e.g., 5 nm and an Ni film having a thickness of 100 nm are sequentially deposited on the resultant structure by vacuum deposition. The photoresist pattern is dissolved by an organic solvent. The Ni and Ti deposition films are lifted off to form the device electrodes 2 and 3 (FIG. 3A).

Step-b

A Cr film having a thickness of about 100 nm is deposited by vacuum deposition and patterned by photolithography to form an opening conforming to an electroconductive film. An organic Pd compound (ccp4230, available from Okuno Seiyaku K.K.) is rotatably applied by a spinner, and a heating and baking treatment is performed to form an electroconductive film 7 formed of fine particles whose principal ingredient is palladium oxide. The film of fine particles is a film consisting of a plurality of fine particles. As for the fine structure, the fine particles are not limited to dispersed particles. The film may also be a film comprising fine particles arranged to be adjacent to each other or overlap each other (an island structure is also included).

Step-c

The Cr film is etched using an acid etchant and lifted off to form the desired pattern of the electroconductive film 7 (FIG. 3B).

Step-d

The device is set in the apparatus shown in FIG. 2. The apparatus is evacuated by the vacuum pump to a degree of vacuum of about $2.7\times10^{-3}$ Pa ($2\times10^{-5}$ Torr). The power supply 10 for applying the device voltage $V_f$ to the device applies the voltage across the device electrodes 2 and 3 to perform electrification process called energization forming. This energization forming process is performed by applying a pulse voltage with a constant or gradually stepping up pulse height. With this energization forming process, the electroconductive film 7 is locally destroyed, deformed, or changed in properties, thus forming the fissure 5006 (FIG. 3C). Simultaneously, a resistance measurement pulse is inserted between the energization forming pulses at a voltage of, e.g., 0.1 V not to locally destroy or deform the electroconductive film 7 during energization forming, thereby measuring the resistance. When the measured resistance of the electroconductive film 7 becomes about 1 MΩ or more, application of the voltage to the device is stopped to end the energization forming.

Step-e

The device which has undergone the energization forming is preferably subjected to processing called activation. With the activation processing, the device current $I_f$ and the emission current $I_e$ largely change. The activation processing can be performed by repeating pulse application in an atmosphere containing, e.g., the gas of an organic substance, as in energization forming. This atmosphere can be obtained using an organic gas remaining in the atmosphere in evacuating the vacuum vessel by using, e.g., an oil diffusion pump or rotary pump, or supplying an appropriate gas of an organic substance into the vacuum obtained by sufficiently evacuating the vacuum vessel using an ion pump or the like. The preferable gas pressure of the organic substance changes depending on the application form, the shape of the vacuum vessel, or the type of organic substance, and is appropriately set in accordance with the situation. Examples of the appropriate organic gas are aliphatic hydrocarbons such as alkane, alkene, and alkyne, aromatic hydrocarbons, alcohols, aldehydes, ketones, amines, phenols, organic acids such as carboxylic acid and sulfonic acid. More specifically, a saturated hydrocarbon represented by $C_nH_{2n+2}$ such as methane, ethane, or propane, an unsaturated hydrocarbon represented by $C_nH_{2n}$ such as ethylene or propylene, benzene, toluene, methanol, ethanol, formaldehyde, acetaldehyde, acetone, methyl ethyl ketone, methylamine, ethylamine, phenol, formic acid, acetic acid, or propionic acid, or a mixture thereof can be used. With this process, carbon and/or a carbon compound resulting from the organic substance present in the atmosphere is deposited on the device, so that the device current $I_f$ and/or the emission current $I_e$ largely changes. The end of the activation processing is appropriately determined while measuring the device current $I_f$ and the emission current $I_e$. The pulse width, the pulse interval, and the pulse height are appropriately set. Carbon and/or a carbon compound means e.g., graphite (graphite contains so-called HOPG, PG, or GC; HOPG is an almost perfect graphite crystal structure, and PG is a slightly disordered crystal structure having crystalline grains of about 20 nm, while GC contains crystal grains having a size as small as 2 nm and has a crystal structure that is remarkably in disarray) or non-crystalline carbon (non-crystalline carbon means amorphous carbon or a mixture of amorphous carbon and fine crystal of graphite). The thickness of carbon and/or carbon compound is preferably 50 nm or less, and more preferably, 30 nm or less. By depositing the carbon compound, the effective width of the fissure decreases so that electrons are scattered and emitted from the distal end of the electroconductive film on the positive device electrode side. When the electron emission positions in the resultant device are averaged along the fissure at a measure of 10 to 100 nm, the electron emission positions are continuously distributed along the fissure, as is known. That is, the electron emission points are almost continuously and uniformly present at a resolution of 10 to 100 nm.

The electron-emitting device obtained by the above processes is preferably subjected to a stabilization process. In the stabilization process, the organic substance in the vacuum vessel and on the device is removed. As the vacuum pump 15 for evacuating the vacuum vessel 16, a pump which uses no oil is preferably used to prevent the oil generated from the apparatus from affecting the device characteristics. More specifically, a vacuum exhaust apparatus such as a combination of a sorption pump and an ion pump can be used. When an oil diffusion pump or a rotary pump is used as the exhaust apparatus, and an organic gas from the oil component generated from the exhaust apparatus is used in the activation processing, the partial pressure of this component must be minimized. The partial pressure of the organic component in the vacuum vessel is preferably so low as not to newly deposit the carbon and/or carbon compound, e.g., $1.3\times10^{-6}$ Pa ($1\times10^{-8}$ Torr) or less, and more preferably, $1.3\times10^{-8}$ Pa ($1\times10^{-10}$ Torr) or less. When the vacuum vessel is to be evacuated, the entire vacuum vessel is preferably heated to easily remove the organic substance molecules adsorbed on the inner wall of the vacuum vessel or the electron-emitting device. The heating is preferably performed at 80° C. to 250° C., and more preferably, 150° C. or more for a time as long as possible. However, the heating condition is not limited to this. Heating is performed under a condition appropriately selected in accordance with various conditions including the size and shape of the vacuum vessel and the structure of the electron-emitting device. The pressure in the vacuum vessel must be minimized and is preferably $1.3\times10^{-5}$ Pa ($1\times10^{-7}$ Torr) or less, and more preferably, $1.3\times10^{-6}$ Pa ($1\times10^{-8}$ Torr) or less. As an atmosphere for driving the device, the atmosphere at the end of the stabilization process is preferably maintained. However, the atmosphere is not limited to this. As long as the organic substance is sufficiently removed, sufficiently stable characteristics can be maintained although the degree of vacuum itself slightly decreases. By employing this vacuum atmosphere, new deposition of carbon and/or carbon compound can be prevented, and $H_2O$ or $O_2$ adsorbed on an inner wall of the vacuum vessel or the substrate of the device also be removed, thus stabilizing the device current $I_f$ and the emission current $I_e$.

The basic characteristics of the electron-emitting apparatus having the above-described device structure and prepared by the above manufacturing method will be described with reference to FIG. 4. FIG. 4 shows the typical relationship among the emission current $I_e$, the device current $I_f$, and the device voltage $V_f$ measured by the electron-emitting apparatus shown in FIG. 2. FIG. 4 is illustrated using arbitrary units because the emission current $I_e$ is much smaller than the device current $I_f$. All axes are represented by linear scales.

As is apparent from FIG. 4, the electron-emitting apparatus has three characteristics for the relationship between the emission current $I_e$ and the device voltage $V_f$. First, when a device voltage equal to or higher than a certain voltage (to be referred to as a threshold voltage hereinafter: $V_{th}$ in FIG. 4) is applied to the device, the emission current $I_e$ abruptly increases. When the applied voltage is lower than the threshold voltage $V_{th}$, almost no emission current $I_e$ is detected. That is, this device is a nonlinear device having the clearly defined threshold voltage $V_{th}$ with respect to the emission current $I_e$. Second, since the emission current $I_e$ depends on the device voltage $V_f$, the emission current $I_e$ can be controlled by the device voltage $V_f$. Third, the amount of arriving charges captured by the attracting electrode 12 depends on the time for which the device voltage $V_f$ is applied. That is, the amount of charges captured by the attracting electrode 12 can be controlled by the time for which the device voltage $V_f$ is applied.

According to the above-described characteristics, at a voltage equal to or higher than the threshold voltage, electrons captured by the attracting electrode 12 are controlled by the pulse height and width of the pulse voltage applied across the opposing device electrodes. At a voltage lower than the threshold voltage, almost no electrons reach the attracting electrode. Even when a number of electron-emitting devices are arranged, the surface-conduction electron-emitting devices can be selected in accordance with an input signal by appropriately applying the pulse voltage to the individual devices, so that the electron emission amount can be controlled.

When a plurality of electron-emitting apparatuses are constituted on the basis of this principle, a flat-type image display apparatus can be formed. The constituting method is disclosed in detail in Japanese Patent Application Laid-Open No. 7-235255. This will be briefly described. A plurality of surface-conduction electron-emitting devices are arranged on the same substrate in correspondence with the pixels of a flat-type image display apparatus. Wires from the device electrodes 2 and 3 are arrayed in a simple matrix as row-directional and column-directional wires. As the attracting electrode, a common electrode is used. Phosphor films are applied on the attracting electrode at positions corresponding to the electron-emitting devices, thereby forming pixels. The pixels can be turned on by electrons attracted by the attracting electrode. In driving, a positive potential V ($V_{th}>V>V_{th}/2$) is selectively applied to the row-directional wires, and a negative potential −V ($V_{th}>V>V_{th}/2$) is selectively applied to the column-directional wires. With this operation, only selected devices along the rows and columns are applied with a device voltage higher than the threshold voltage $V_{th}$. On the basis of this fact and the above-described characteristics of the electron-emitting apparatus using the surface-conduction electron-emitting device, only the selected devices along the rows and columns can be driven.

In addition to the above-described electron-emitting apparatus using the general surface-conduction device, the following invention has been applied. A surface-conduction electron-emitting device in which the positive device electrode and the negative device electrode are not symmetrical is proposed in Japanese Patent Application Laid-Open Nos. 1-311532, 1-311533, and 1-311534. In Japanese Patent Application Laid-Open Nos. 1-311532, 1-311533, and 1-311534, the object is to shape an electron beam arriving at the attracting electrode. The present invention is to solve a problem different from that of the prior arts, as will be described later.

In the flat-type display apparatus according to the principle of the electron-emitting apparatus described in the prior art, an efficiency η ($\eta=I_e/I_f$) corresponding to the ratio of the emission current amount $I_e$ of electrons arriving at the attracting electrode 12 to the device current amount $I_f$ is preferably high. More specifically, when the efficiency η can be raised, the device current $I_f$ necessary for obtaining the same emission current $I_e$ can be decreased. It can be expected that the wires for connecting the devices be easily designed, or degradation of devices be suppressed.

The problem to be solved by the present invention is to improve the efficiency of the electron-emitting apparatus while maintaining a constant current amount at the attracting electrode.

To describe this problem in more detail, the mechanism of the electron-emitting apparatus using the surface-conduction electron-emitting device will be described below.

As described above, with the process called energization forming and the process called activation, a fissure is formed in the electroconductive film of the surface-conduction electron-emitting device such that the electroconductive film is divided into a portion electrically connected to the positive device electrode and a portion electrically connected to the negative device electrode. It is found that, of this fissure in the film, a portion having a width of nm order is present. In addition, various examination experiments and computer simulations reveal that electrons are almost isotopically emitted from the distal end portion of the higher potential-side film neighboring the portion of the fissure of nm order (exactly, assuming that electrons are isotopically emitted from the distal end portion of the higher potential-side film portion, the experimental results coincide with the simulation results without any contradiction). The higher potential-side film portion is an electrically connected portion which can be regarded as an equipotential portion including the electroconductive film 5004 and the positive device electrode 2. Similarly, a portion which can be regarded as an equipotential portion including the electroconductive film 5005 and the negative device electrode 3 will be referred to as a lower potential-side film portion hereinafter.

By examining the motion of electrons in an electrostatic field, it is found that the electrons emitted from the distal end of the higher potential-side film portion exhibit behavior different from those emitted from the negative device electrode side as in a field-emission electron-emitting device. The characteristic motion of electrons in the electron-emitting apparatus using the surface-conduction electron-emitting device will be examined below.

The fissure in the actual surface-conduction electron-emitting device has an irregular zigzag shape. The amplitude of the zigzag fissure is often almost ½ or less the width between the positive device electrode and the negative device electrode although it depends on the device formation method or the like. Therefore, a theory must be constituted in consideration of the zigzag fissure. For the descriptive convenience, a device having a zigzag fissure with a minimum amplitude and a theoretical model corresponding to this device will be described first. That is, an electrostatic potential distribution for a linear fissure will be described. FIGS. 5A to 5C are sectional views of potential distributions of various orders. (After examination of the motion of electrons for the linear fissure, that for the zigzag the fissure will be examined in detail, and the problem for the present invention will be described).

Assume that a fissure 30 portion is a linear fissure, and the surfaces of the device electrodes and the film portions are on a plane where z=0 and extend to have a sufficiently larger area than a given region (a region 34 in FIG. 6; to be described later in detail). When the potential distribution can be regarded to be completely binarized on a higher potential-side film portion 31 and a lower potential-side film portion 32, the higher potential-side film portion 31 and the lower potential-side film portion 32 can be electrostatically approximated as two opposing electrode plates. When the distance H between the device and the attracting electrode 12 is sufficiently large as compared to the given region 34, the field distribution ($E_x$, 0, $E_z$) in the electron-emitting apparatus using the surface-conduction electron-emitting device is given by equation (1) while regarding the (x,y) plane as a complex plane:

Equation (1)

$$E_x + iE_z = \frac{V_f}{2\pi}\frac{-i}{\sqrt{(x-iz)^2-(D/2)^2}} + i\frac{V_a}{H}$$

where $i=\sqrt{-1}$, and π is the circle ratio. The center of the coordinates is set at the center of the fissure, and D is the effective fissure width. $V_f$ is the voltage applied to the device within the range of several to several tens V. $V_a$ is the voltage applied across the device and the attracting electrode within the range of several to several tens kV. The distance H between the device and attracting electrode is on the order of several mm. Therefore, $V_a/H$ is on the order of about $10^6$ to $10^7$ V/m.

The effective width D means a width as a parameter fitted to equation (1) such that the width matches the actual electric field at a position separated from the center of the fissure by a distance several tens times the size of the fissure. As is experimentally known, this width is on the order of several nm in the surface-conduction electron-emitting device.

FIGS. 5A to 5C show potential distributions obtained by integrating the electric field described by equation (1) by various scales. FIG. 5A shows the potential distribution of mm order. FIG. 5B shows the potential distribution of $\mu$m order. FIG. 5C shows the potential distribution of nm order. (The fissure, the higher potential-side film portion, the lower potential-side film portion, and the attracting electrode 12 which are approximated by equation (1) will be represented by 30, 31, 32, and 33, respectively, and corresponding portions are shown in FIGS. 5A to 5C).

The electric field becomes zero on a straight line parallel to the fissure (Y-axis) on the plane where z=0, in which the value x is given by equation (2) below:

Equation (2)

$$x_s = \frac{D}{2}\sqrt{1+\left(\frac{2V_f H}{V_a D\pi}\right)^2}$$

When the potential is regarded as the imaginary part of a complex fluid potential, a point where the flow field stagnates corresponds to the field zero point because of the nature of the potential as a harmonic function. On the basis of the analogy between the fluid and the electrostatic field, the linear portion where the electric field stagnates will be referred to as a stagnation line, or a stagnation point 35 based on the sectional shape of the (x,z) plane. A distance $x_s$ from the center of the fissure to the stagnation point 35 is a length representing the characteristic feature of this system.

On the order in the electron-emitting apparatus, $x_s$>>D, and $x_s$ can be sufficiently approximated as equation (3):

Equation (3)

$$x_s = \frac{V_f}{\pi}\frac{H}{V_a}$$

As is apparent from equation (3), $x_s$ does not depend on the effective width D ($x_s$>>several nm). When $V_a$ is 1 kV, $V_f$ is 15 V, and H is 5 mm, $x_s$ is about 23.9 $\mu$m.

The approximation of equation (3) corresponds to field distribution approximated as equation (4) below:

Equation (4)

$$E_x + iE_z = -\frac{V_f}{2\pi}\frac{i}{x-iz} + i\frac{V_a}{H}$$

When the ratio of $x_s$ to the fissure width is sufficiently high, i.e., in a region outside a semicircular cylinder having a radius of several times the effective fissure width D from the center of the fissure 30, this approximation is a good approximation. The first term on the right side of equation (4) represents a so-called revolving field. The second term represents an electric field called a longitudinal field. The characteristic field in the electron-emitting apparatus using the surface-conduction electron-emitting device can be approximated by the sum of the revolving field and the longitudinal field.

The potential distribution corresponding to equation (4) is obtained by integrating equation (4) as equation (5):

Equation (5)

$$V(x+iz) = Im\left(\frac{Vf}{2\pi}\log\left(\frac{x+iz}{x-iz}\right) + i\frac{V_a}{H}Z\right)$$

where Im represents the imaginary part.

Analysis of the electric field given by equation (1) shows that a region where the electric field has a vector component in the positive direction of the Z-axis is present in the higher potential-side film portion 31. The region has a solid semicircular cylindrical shape obtained by translating, along the Y-axis, an almost semicircular region having a radius ½ $x_s$ while setting the central axis at the center of the fissure 30 and the center of the stagnation point 35. In this region, electrons receive a downward force. This region will be referred to as a negative gradient region 36 hereinafter. The corresponding region is indicated as a hatched portion in FIG. 5B. When approximation of equation (4) holds, the negative gradient region 36 is surrounded by a perfect semicircle and the X-axis on the Z-X plane.

Even when electrons are emitted from the distal end portion of the higher potential-side film portion 31 by a certain effect, the electrons fall in the negative gradient region 36 upon receiving the downward force (in the negative direction of the Z-axis in FIG. 5B). In addition, various analyses reveal that the electrons fall onto the surface of the higher potential-side film portion 31, some electrons are absorbed into the higher potential-side film portion 31 and flow as the device current, and some other electrons are scattered into the vacuum again. The electrons are emitted from the distal end portion of the higher potential-side film portion 31, and then repeatedly fall and scatter. Only electrons completely passing through the negative gradient region 36 reach the attracting electrode 33 and become the emission current.

When the lengths of the higher potential-side film portion 31 and the lower potential-side film portion 32 along the X direction are larger than $x_s$, the film portions can be regarded as opposing electrode plates, as in the above approximation. When the scale of the zigzag fissure is much smaller than $x_s$, the fissure can be regarded as a linear fissure.

In the above sense, the fissure in the surface-conduction electron-emitting device can be regarded as a linear fissure. The above-described "given region" is a parallelepiped cylindrical region extending along the Y direction and having a height of several to several tens times $x_s$ from the device surface in the Z direction, at which electrons are present, and having a size of twice to ten times the stagnation point in the X direction. That is, 1) the fissure portion can be regarded as a linear fissure when the width of the meander is smaller than $x_s$, 2) the unevenness of a surface of the portion of the films and electrodes of the device are much smaller than $x_s$, 3) the higher potential-side film portion and the lower potential-side film portion extend across a sufficiently larger area than the region enclosed in the parallelepiped cylinder, and 4) when H>>$x_s$ holds, the system can be considered to have a field distribution described by equation (1) or (4). The electron-emitting apparatus using the general surface-conduction electron-emitting device almost satisfies the above conditions.

Electrons passing through the region enclosed in the parallelepiped cylinder exhibit a motion which can be regarded as an almost parabolic motion due to the parallel field shown in FIG. 5A between the device and the attracting electrode 33.

The field distribution approximated by equation (1) or (4) has a nature different from that in the electron-emitting apparatus in which the capture electrode corresponding to the attracting electrode 33, and electrodes corresponding to the equipotential portions 31 and 32 are formed on the same substrate. When the value of the voltage applied to the device is large, e.g., when $V_f$ is 200 V, $V_a$ is 1 kV, and H is 5 mm, $x_s$ is about 300 $\mu$m. To form the device described by equation (1) or (4), a device of mm order must be considered. Therefore, when the value of the voltage applied to the device is large, and the device size is on the order of submillimeter or less, it can be easily estimated that the device has a field distribution different from the characteristic field distribution of the above-described surface-conduction electron-emitting device.

Almost all the characteristic features of the electrostatic system have been described above. The relationship between the motion of electrons and the electrostatic structure of this system will be described below.

Because of the energy conservation law, the energy of electrons emitted from the device (into the vacuum) is given by ($eV_f$–$W_f$) where e is the charges of electrons, and $W_f$ is the averaged work function on the surface of the higher potential-side film portion 31. Since $V_f$ is several to several tens V, and the work function is about 5 eV or so, for general material, the electrons have an energy of several to several tens eV. Electrons having the energy of several to several tens eV have a nature different from those having a high energy, as is known, although the details of the nature have not been clarified. As is apparent from various examinations, elastic scattering occurs on the surface of the higher potential-side film portion 31. When the entire ratio of the elastic scattering components is represented by β, the value β is about 0.1 to 0.5. In addition, since the electrons exhibit a wave-like behavior in terms of quantum theory because of their low energy, and the film surface has three-dimensional patterns (unevenness), there are isotopically scattering components. Therefore, it is classically interpreted that the ratio of components which are scattered in a certain direction seems to be probabilistically given.

Because of such a scattering mechanism, it can be understood that the motion of electrons must be statistically handled. In addition, since the value β is less than 1, it is found that electrons in the vacuum decrease by the power of the value β every time the scattering is repeated.

Such multiple scattering is considered to decrease the efficiency $\eta(=I_e/I_f)$. Therefore, as a means for improving the efficiency, the number of times of falling of electrons onto the surface of the higher potential-side film portion 31 must be decreased.

As described above, the surface-conduction electron-emitting device having the linear fissure 30 absolutely has the negative gradient region 36 having an almost semicircular shape, and this negative gradient region 36 contributes to falling of electrons onto the surface of the higher potential-side film portion 31. Therefore, control of this negative gradient region 36 is the most important challenge.

In the above description, however, the degree of reduction of the negative gradient region 36, and the comparison target to which the size of the negative gradient region 36 is relatively reduced are obscure. The characteristic length of this system, which is determined by the energy of electrons, will be described next. This length is determined by the motion of electrons.

In the negative gradient region 36 and near the fissure 30, the electric field can be regarded as a revolving field by primary approximation. The motion of electrons associated with the revolving field at $V_a$=0 has been analyzed by equation (4). As a result, it is found that when the Y-direction distribution of points where electrons isotopically emitted from a point ($x_0$,0,0) on the higher potential-side film portion 31 fall onto on the higher potential-side film portion 31 is integrated, the distribution is almost represented by the following function by simulation:

Equation (6)

$$f(x)dx = \begin{cases} Ng_0(x)dx \text{ for } D/2 \le x < x_0 \\ \frac{N}{x}dx \text{ for } x_o \le x \le Cx_0 \\ 0 \text{ for } Cx_0 < x \end{cases}$$

where N is the normalization constant, $g_0$ is the positive monotonously increasing function, and C is the magnification parameter represented by equation (7) below:

Equation (7)

$$C = \exp\left(-5.6\left(\frac{eV_f}{W_f + eV_f}\right)^2 + 27.3\left(\frac{eV_f}{W_f + eV_f}\right) - 12.2\right)$$

That the orbits of electrons are determined only by the magnification at the emission position means that, when $V_a$ is 0, the characteristic length is not present in this system. The maximum arrival position is also determined by the multiple of the emission position from the central portion of the fissure. Therefore, it can be considered that the emitted or scattered electrons rise at maximum to the height (in the positive direction of the Z-axis) on the order of:

Expression (8)

$$Cx_0$$

When $V_f$ is 14 V, and $W_f$ is 5.0 eV, C is 130. When $x_0$ is 5 nm, $Cx_0$ is about 650 nm.

When the length determined by the motion of electrons is known, the comparison target to which the relative size of the negative gradient region 36 must be determined is obvious. That is, the negative gradient region 36 is not so large as compared with $Cx_0$.

The effect of the zigzag fissure will be examined below. From the above examination, when the simplified electric field (1) is further approximated, the equation (1) can be rearranged as equation (4). Since the electrons undergo the probabilistic process, i.e., scattering, the calculation shows that the set of the orbits of electrons has a distribution at almost the same density as that obtained by equation (1) and in the electric field of equation (4). (In equation (6), the effect depending on the presence/absence of the effective fissure width D, and the like are calculated. As is known, when the fissure width is sufficiently smaller than $x_s$ the orbits of electrons are not largely affected by the presence/absence of the fissure width D. This condition is satisfied in the conventional electron-emitting apparatus). It can be understood that the electric field of equation (4) for the sufficiently small effective fissure width D (D=0) is the characteristic electric field of the electron-emitting apparatus using the surface-conduction electron-emitting device. Therefore, it is important to examine the electric field formed by the device portion consisting of the higher potential-side film portion 31 and the lower potential-side film portion 32 and the attracting electrode 33 for the sufficiently small effective fissure width D (D=0).

Even for the zigzag fissure, the ratio ($x_s$/H) of the maximum value of $x_s$ to the distance between the attracting electrode 33 and the device can be considered to be sufficiently small (H>>$x_s$). This ratio can be approximated as the linear sum (superposition) of the electric field formed by the device portion consisting of the higher potential-side film portion 31 and the lower potential-side film portion 32 and the electric field formed by the attracting electrode 33 when no effective fissure width is present.

Even when the actual fissure has a non-zero width, the substantial portion of the electric field of the zigzag fissure is expected to be the field distribution of the device portion when the effective fissure width is sufficiently small (D=0).

Assuming that the potential of the lower potential-side film portion 32 is zero, calculation reveals that the potential distribution formed by the device portion having the zigzag fissure present on the two-dimensional plane and having the sufficiently small width (D=0) is proportional to the solid angle with respect to the higher potential-side film portion 31 because of the characteristics of the Green's function on the half-space. When the shape of the higher potential-side film portion 31 is represented by Λ, and the solid angle from a point (x,y,z) on the half-space where z>0 with respect to the higher potential-side film portion 31 s represented by $\Omega_\Lambda(x,y,z)$, the potential at that point is given by equation (9) below:

Equation (9)

$$V(x, y, z) = \frac{V_f}{2\pi}\Omega_\Lambda(x, y, z) + \frac{V_a}{H}z$$

(When $V_a$ is 0, the potential sensed by electrons corresponds to the solid angle with respect to the higher potential-side film portion, as shown in FIG. 7). The electric field is obtained by direction-differentiating this potential. Even for the non-zero fissure width, equation (9) holds with good approximation when the effective fissure width D is sufficiently smaller than $x_s$, as is apparent from the above examination.

Assuming that the fissure is formed on the X-Y plane where z=0, and along the Y-axis where (x,y,z)=(0,y,0), it can be easily confirmed that equation (9) returns to equation (5).

From the viewpoint of reduction of the negative gradient region, the relationship between equation (9) and the negative gradient region will be examined below. The negative gradient region can be understood as the dominant region of the revolving field formed by the electron-emitting device. More specifically, on the boundary line of the negative gradient region, the Z-direction component of the revolving field balances the longitudinal field formed by the attracting electrode 33, and the revolving field is dominant in this region. Assuming that the potential of the lower potential-side film portion 32 is zero, the equipotential line (plane) of the value $V_f$ starts from the stagnation point (line) and becomes parallel to the X-Y plane at a position sufficiently separated from the fissure to the lower potential-side film portion 32. When a region inside (on the side including the fissure) of the equipotential line (plane) of $V_f$ is called a device potential region, it can be easily understood that the negative gradient region is confined in the device potential region. This nature does not depend on whether or not the fissure is a linear fissure.

The negative gradient region 36 can be made small by reducing the device potential region. FIGS. 8A to 8D show actually formed characteristic potentials. FIGS. 8A and 8C are plan views of device models, in which the corresponding higher potential-side film portion and lower potential-side film portion are represented by 31 and 32, respectively. FIGS. 8B and 8D show potential distributions corresponding to the linear and zigzag fissures shown in FIGS. 8A and 8C, respectively, on the sections taken along the dotted lines in FIGS. 8A and 8C. A negative gradient region 40 enclosed by a line becomes small.

To reduce the device potential region, the area of the higher potential-side film portion 31 may be increased with respect to the orbits of electrons, as can be concluded from equation (9). However, in the conventional surface-conduction electron-emitting device, the zigzag fissure is not controlled, and the electron-emitting portion is not controlled, either, so this idea has not been put into practical use.

This will be described in more detail. For the descriptive convenience, the fissure in the conventional surface-conduction electron-emitting device is modeled. Examination will be made for a fissure as shown in FIG. 9A, in which partially linear portions of the fissure are periodically arranged. The longitudinal amplitude is about 10 μm, and the period is about 20 μm. The ratio of electrons emitted from the distal end of the higher potential-side film portion and reaching the attracting electrode is calculated by computer simulation. In FIG. 9B, the abscissa represents the position, and the ordinate represents the efficiency. The straight line parallel to the abscissa represents the calculation result for a linear fissure. For $Cx_0$ above the fissure, when a portion where the solid angle with respect to the higher potential-side film portion exceeds η is present, a portion where the solid angle becomes smaller than π is simultaneously generated. Reflecting this fact, at some portions, the efficiency exceeds that for the linear fissure and, at some other portions, the efficiency is lower than that for the linear fissure, as shown in the graph of FIG. 9B. For this reason, when portions where electrons are emitted are distributed along the fissure across the device portion, the average electron arrival ratio is almost the same as that for the linear fissure. When the amplitude and period are smaller than those for the zigzag fissure shown in FIG. 9A, the difference from the negative gradient region for the linear fissure effectively becomes small. The shape of the negative gradient region becomes closer to that for the linear fissure than that shown in FIG. 9A. Therefore, it can be estimated that the effect of the small zigzag fissure be neglected. Actually, such an effect was obtained by numerical experiment based on simulation.

As described above, when at least the amplitude of the zigzag fissure is relatively small, the negative gradient region becomes small at some portions although the negative gradient region simultaneously becomes large at some other portions. For this reason, for a simple zigzag fissure, the entire electron arrival ratio and the efficiency cannot be improved.

SUMMARY OF THE INVENTION

It is an object of the present invention to improve the efficiency as the ratio of the amount of a current flowing through a surface-conduction electron-emitting device to the current amount of electrons arriving at an attracting electrode by controlling an electric field received by the electrons which have already been emitted from the device (into a vacuum). The purpose of this challenge is different from that of electric field control for extracting electrons from a substance. Therefore, a means for solving this problem is different at all in terms of idea, and its effect is also different at all.

One of the factors dominating the efficiency is the size of the negative gradient region. As described above, the size of the negative gradient region depends on the shape of the negative gradient region. In the present invention, the negative gradient region is controlled by controlling the shape of the fissure and the position of the electron-emitting portion to solve the above problem.

More specifically, since the negative gradient region is small at portions projecting to the higher potential-side film portion side of the fissure, the distribution of electron-emitting portions is controlled such that only the projecting portions emit electrons.

When electrons are selectively emitted from portions with a high electron arrival ratio, the average electron arrival ratio can increase, so that the efficiency can be made much higher, as will be described later in detail.

The present invention is constituted to give a design guidance for increasing the efficiency. As is known, when a surface-conduction electron-emitting device is subjected to activation processing, and the electron-emitting portions along the fissure are averaged in a region along the fissure over a length of at least several tens nm to 100 nm and observed at a larger measure, the average distribution of electron-emitting portions is almost continuous and uniform along the fissure. The electron-emitting portions can be designed and constituted as a continuous line segment in the above sense by using the unique characteristics of the surface-conduction electron-emitting device. The present invention is constituted, by using this specific nature of the surface-conduction electron-emitting device, to give the design guidance for increasing the efficiency without decreasing the current amount at the attracting electrode.

To reduce the negative gradient region, some variations in shape can be considered. To efficiently constitute the negative gradient region, the shape is limited to a periodical shape in the present invention. (This periodical shape can easily replace a general aperiodic shape).

Various shapes will be described in the present invention, and these shapes include various shape parameters. Basically, the shapes have three parameters, i.e., a period $l_p$, an amplitude $l_a$, and a length (emission length) $l_e$ of an electron-emitting portion, as common factors. The roles of the three shape parameters will be explained on the basis of the typical shape of the present invention.

FIGS. 10A to 10D show the typical example of the present invention. Changes in efficiency and the current amount $I_e$ at the attracting electrode according to the parameters will be described on the basis of this example. Consequently, parameter ranges for actualizing the effect are determined, and a guidance for designing and controlling the fissure shape is given such that the shape parameters fall within the ranges. With the fissure controlled according to the guidance, the challenge of the present invention can be achieved, i.e., the efficiency can be increased without decreasing the current amount $I_e$.

FIG. 10A is a plan view showing the simplest shape of the present invention. As shown in FIG. 10A, the fissure is artificially controlled and formed into a periodical rectangular shape constituted by line segments at 90°. In FIG. 10A, thick lines 38 represent electron-emitting portions. At the portions 38 of the fissure, electrons are emitted from the distal end portion of the higher potential-side film portion along the fissure. The remaining fissure portions are designed not to emit electrons by a certain technique. The length of the line segment of the isolated electron-emitting portion is represented by $l_e$. The amplitude along the Y direction is represented by $l_a$, as shown in FIG. 10A. The period of the periodical pattern is represented by $l_p$.

The dependency on $l_e$ will be examined first. FIG. 10B is a graph showing the dependencies on $l_e$ of the ratios of the efficiency $\eta$ and current amount $I_e$ at the attracting electrode for the zigzag fissure to those for a linear fissure, which are observed when remaining parameters are fixed. As is apparent from FIG. 10B, as $l_e$ becomes small, the efficiency increases. However, in the surface-conduction electron-emitting device, the electron-emitting points continuously exist at a resolution of at least 100 nm. For this reason, when the length of the electron-emitting portion is reduced, the electron emission amount at the distal end of the higher potential-side film portion linearly decreases accordingly. The current amount $I_e$ has a peak as shown in FIG. 10B. ($I_e$ is proportional to the product of the efficiency and the length $l_e$).

FIG. 10C shows the dependency of efficiency on $l_p$ which is observed when the period $l_p$ of the fissure shape is changed while fixing the remaining parameters. As $l_e$ becomes large, the efficiency increases (monotonously increases). Simultaneously the dependency is found to converge. When the device length $W_1$ is fixed, an increase in period is equivalent to reduction of the total electron-emitting portion length. Therefore, an increase in $l_p$ causes a decrease in current amount $I_e$ at the attracting electrode 12, as a practical problem ($I_e$ is almost proportional to $\eta$ and almost inversely proportional to $l_p$). FIG. 10C also shows the dependency of $I_e$ when the device length $W_1$ is fixed. Therefore, $l_p$ also has an optimum range depending on the target effect, like $l_e$.

FIG. 10D shows the relationship between the amplitude $l_a$ of the fissure and the efficiency. For this fissure shape, the amplitude is not related to the electron-emitting portion length. The dependency of $I_e$ on $l_a$ is present only on the basis of the efficiency $\eta$, and $I_e$ is proportional to the efficiency $\eta$. As $l_a$ increases, the efficiency monotonously increases. This dependency also converges to a certain value. In actually manufacturing the device, $l_a$ must be a finite length due to various reasons such as pitch of pixels and also has an optimum value, as a practical problem.

The certain shape (FIG. 10A) has been examined above. These results sometimes largely change in values because of the shape parameters which are complexly intertwined with each other, the potential $V_a$ of the attracting electrode, or the device voltage $V_f$. However, the above-described qualitative properties do not change.

Similar examination can also be made for shapes shown in FIGS. 11A to 11C.

In the present invention, examination based on normally considerable conditions revealed that the parameters are preferably selected within the following ranges:

$5\ \mu m \leqq l_p \leqq 80\ \mu m$ $1\ \mu m \leqq l_e \leqq 40\ \mu m$ $1\ \mu m \leqq l_a \leqq 100\ \mu m$ These parameters within the ranges make the total efficiency more than 1.2 times larger than that of the device having the linear fissure.

Preferably, the characteristic length $l_a$ of the zigzag fissure is set to be almost equal to or larger than the scale $x_s$ of the stagnation point.

In the conventional zigzag fissure, the increase in efficiency of electron emission from the portions projecting to the higher potential side of the zigzag fissure cancels the decrease in electron-emitting efficiency from the concave portions. For this reason, the efficiency is not so different from that for a linear fissure.

However, this does not apply to a case wherein the amplitude $l_a$ is sufficiently large. As shown in FIGS. 12A and 12B, assume that a controlled fissure is formed, and electrons are emitted from the entire region of the fissure. When the electron-emitting efficiency per unit length is referred to as an efficiency density, the distribution of the efficiency density can be defined along the line element of the fissure. When the amplitude $l_a$ becomes large, the efficiency density at the projecting portion (corresponding to the portion 38 in FIG. 12) nonlinearly increases with respect to $l_a$. At the concave portion (corresponding to the portion 39 in FIG. 12A), the efficiency density has a lower limit value because it is a nonnegative function. When $l_a$ is small, these efficiency densities can be linearized near $l_a=0$. For the zigzag fissure in the conventional surface-conduction electron-emitting device, the integral value obtained by integrating the efficiency densities with respect to the emission portion along the fissure, i.e., the (total) efficiency in this system is almost the same as that for the linear fissure. However, when $l_a$ is increased, the electron-emitting efficiency density at the projecting portion increases, so that the integral value (total efficiency) across the entire region becomes larger than that for the linear fissure in some cases. The efficiency density largely depends on the shape of the fissure and can be obtained as the integral value of a distribution function. (Assume that the efficiency density is very high at a portion in a region. Even in this case, as long as the measure is small, and the efficiency density in another region is much lower than that for the linear fissure, the total efficiency becomes lower than that for the linear fissure). However, numerical experiments revealed that, even when a continuous electron-emitting portion is formed, the electron-emitting efficiency can be increased for the shapes shown in FIGS. 11A to 11C. As a result of examination, the parameters are preferably selected within the following ranges. In this case, $l_e$ represents the length of a portion projecting to the higher potential side of the insulated region:

$5\ \mu m \leqq l_p \leqq 80\ \mu m$ $1\ \mu m \leqq l_e \leqq 20\ \mu m$ $5\ \mu m \leqq l_a \leqq 100\ \mu m$ $V_a/H \leqq 0.5\times10^6$[V/m]

The limitation of the electric field $V_a/H$ is owing to the fact that for larger values of $V_a/H$, the efficiency density at the protruding portion does not increase enough and then the total efficiency does not become greater than that of the device having the linear fissure.

It is therefore an object of the present invention to provide an electron-emitting apparatus using a surface-conduction electron-emitting device having a fissure in a controlled shape and a controlled electron-emitting portion on the basis of the above design idea.

According to a first aspect of the present invention, there is provided an electron-emitting apparatus constituted by an electron-emitting device having an electroconductive film which includes electron-emitting portions, and an electrode for attracting electrons whose potential is higher than that of the electroconductive film by $V_a$ and whose distance from the film is H, wherein an electrically insulated elongated region is formed in the electroconductive film to divide the electroconductive film into a higher potential side and a lower potential side so that a potential difference $V_f$ may be formed, the insulated region having a width D within the region $(V_fH/V_aD)>>1$ and having a substantially periodical shape formed of portions projecting to the higher potential side and portions projecting to the lower potential side, and continuous electron-emitting portions, preferably alternating with portions where no electrons are emitted, are present at at least part of the portion projecting to the higher potential side in one period of the insulated region. Preferably, a length $l_e$ of the electron-emitting portion included in one period of the insulated region, a period $l_p$ of the insulated region, and a zigzag distance $l_a$ between the portion projecting to the higher potential side and the portion projecting to the lower potential side in the insulated region fall within the following ranges:

$5\ \mu m \leqq l_p \leqq 80\ \mu m$ $1\ \mu m \leqq l_e \leqq 40\ \mu m$ $1\ \mu m \leqq l_a \leqq 100\ \mu m$ In addition to the above conditions, according to the present invention, there is also provided an electron-emitting apparatus, wherein the electron-emitting device having the electroconductive film which includes the electron-emitting portions further comprises a pair of opposing device electrodes, a portion on the higher potential side and a portion on the lower potential side of the electroconductive film are electrically connected to the device electrodes, respectively, and a region sandwiched by the device electrodes has a periodical shape formed of portions projecting to the higher potential side and portions projecting to the lower potential side, and the electroconductive film mainly exists at the portions projecting to the higher potential side in the region sandwiched by the device electrodes.

According to the present invention, carbon and/or a carbon compound may be present on and near the electron-emitting portion.

According to the present invention, the electron-emitting device may be a surface-conduction electron-emitting device.

According to a second aspect of the present invention, there is provided an electron-emitting apparatus constituted by an electron-emitting device having an electroconductive film which includes electron-emitting portions, and an electrode for attracting electrons, wherein an electrically insulated elongated region is formed in the electroconductive film to divide the electroconductive film into a higher potential side and a lower potential side, the insulated region having a substantially periodical shape formed of portions projecting to the higher potential side and portions projecting to the lower potential side, a continuous linear electron-emitting portion is formed in the insulated region, and a length $l_e$ of the portion projecting to the higher potential side included in one period of the insulated region, a period $l_p$ of the insulated region, and a zigzag distance $l_a$ between the portion projecting to the higher potential side and the portion projecting to the lower potential side in the insulated region fall within the following ranges:

$5\ \mu m \leqq l_p \leqq 80\ \mu m$ $1\ \mu m \leqq l_e \leqq 20\ \mu m$ $5\ \mu m \leqq l_a \leqq 100\ \mu m$ and a potential difference $V_a$ between the attracting electrode and the electroconductive film of lower potential side and a distance between the attracting electrode and the electron-emitting device satisfy the following relationship $V_a/H \leqq 0.5\times10^6$ [V/m].

According to the present invention, there is also provided an electron-emitting apparatus, wherein the electron-emitting device having the electroconductive film which partially includes the electron-emitting portion further comprises a pair of opposing device electrodes, a portion on the higher potential side and a portion on the lower potential side of the electroconductive film are electrically connected to the device electrodes, respectively, and a region sandwiched by the device electrodes has a periodical shape formed of portions projecting to the higher potential side and portions projecting to the lower potential side, and the electroconductive film exists in the region sandwiched by the device electrodes.

According to the present invention, carbon and/or a carbon compound may be present on and near the electron-emitting portion.

According to the present invention, the electron-emitting device may be a surface-conduction electron-emitting device.

According to a third aspect of the present invention, there is provided an electron-emitting apparatus comprising:

an electron source in which a plurality of electron-emitting devices are arranged on a substrate, the electron-emitting device constituting the above electron-emitting apparatus; and an electrode for attracting electrons.

According to the present invention, wires electrically connected to the electron-emitting devices may be formed in a matrix in the electron source.

According to the present invention, wires electrically connected to the electron-emitting devices may be formed in a ladder-shape in the electron source.

According to a fourth aspect of the present invention, there is provided an image-forming apparatus having an arrangement of the above electron-emitting apparatus, wherein the attracting electrode emits light upon irradiation of an electron beam emitted from the electron source to form an image.

According to a fifth aspect of the present invention, there is provided a method of manufacturing an electron-emitting apparatus described at the beginning of the summary, comprising the steps of:

removing part of the electroconductive film by any one of micropatterning technique of focused ion beam, laser processing, and photolithography to form a portion other than the electron-emitting portion in the insulated region; and applying a voltage to the electroconductive film to flow a current, thereby forming the electron-emitting portion.

DESCRIPTION OF THE PREFERRED EMBODIMENTS

The present invention will be described in more detail by way of its examples.

EXAMPLE 1

Figure 1A:
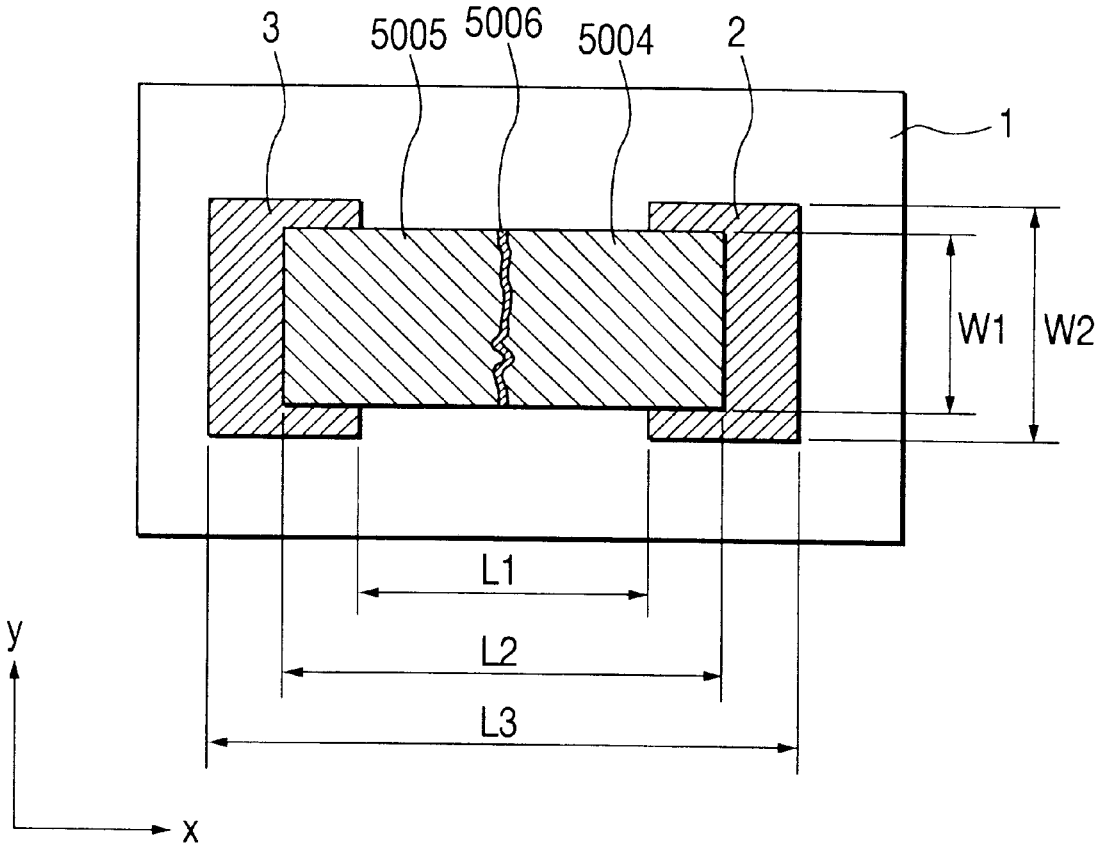
FIGS. 1A and 1B are views showing the basic structure of a conventional surface-conduction electron-emitting device.
Figure 1B:
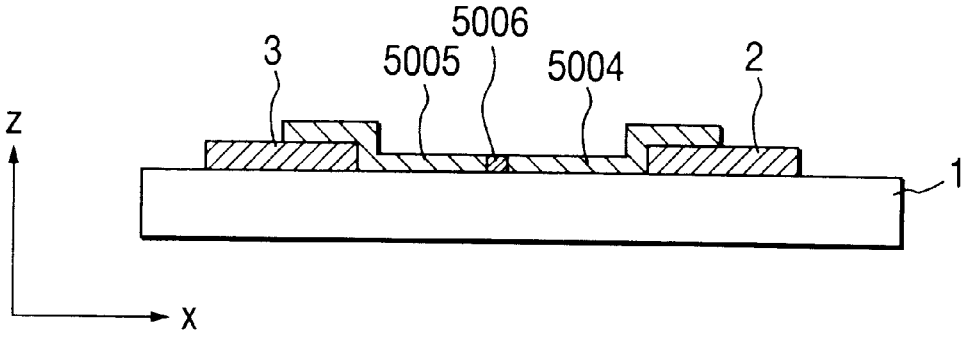
Figure 13A:
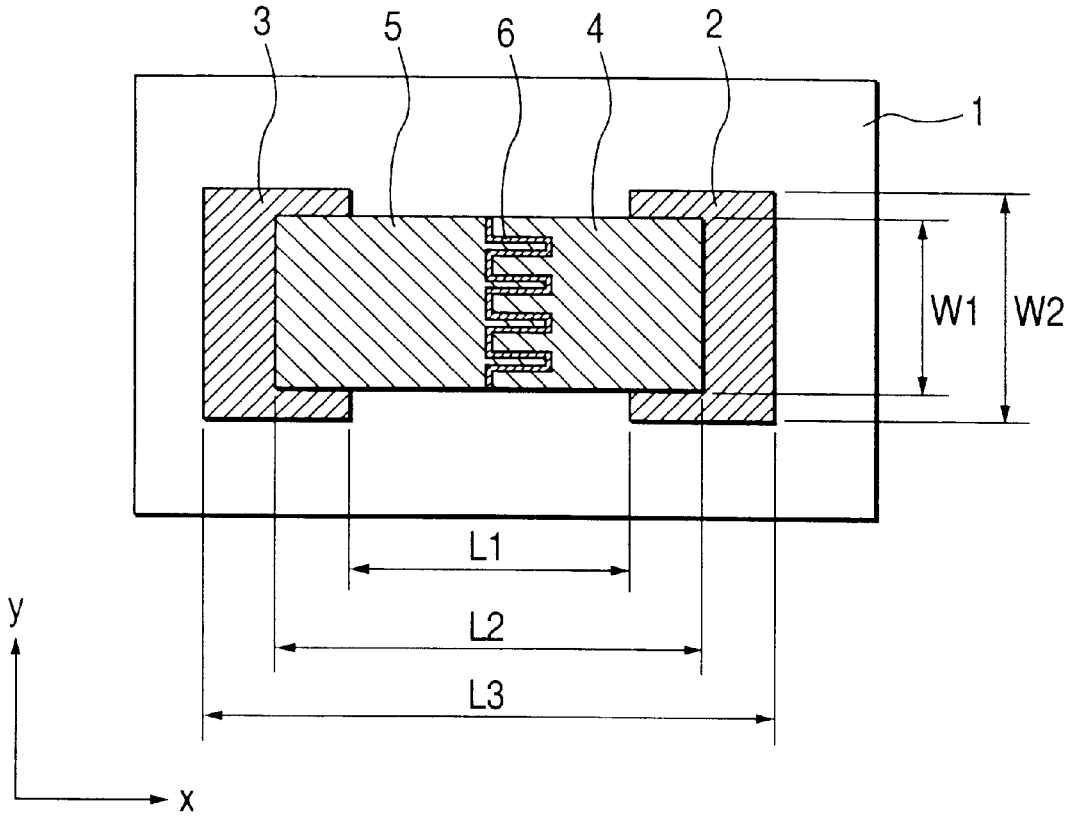
FIGS. 13A and 13B are views showing the basic structure of a surface-conduction electron-emitting device of the present invention.
Figure 13B:
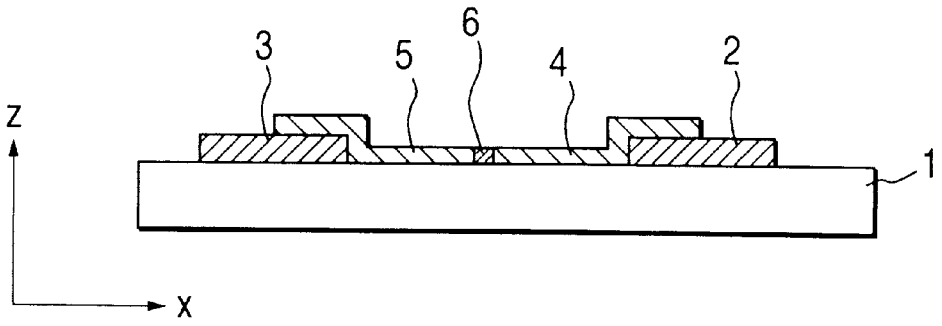

An electron-emitting device of this example has the same structure as that shown in FIGS. 1A and 1B of the prior art. However, the fissure 5006 which is not controlled in the prior art is controlled in the present invention to obtain a fissure 6 as shown in FIGS. 13A and 13B. A method of manufacturing the electron-emitting device of the present invention will be described with reference to FIGS. 14A to 14C.

Step-a

Figure 14A:
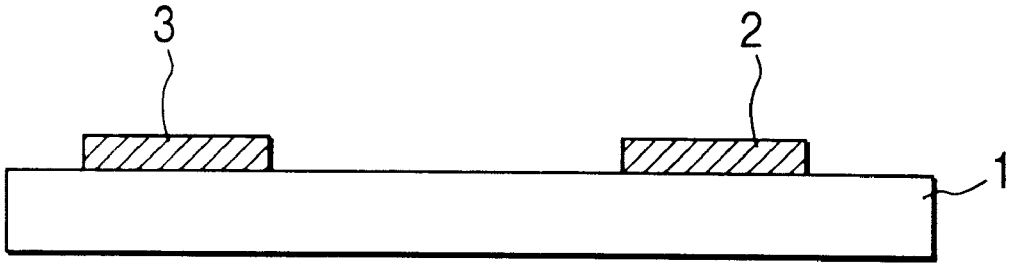
FIGS. 14A, 14B and 14C are sectional views for explaining a method of manufacturing the surface-conduction electron-emitting device of the present invention.

A Ti film having a thickness of 5 nm and a Pt film having a thickness of 30 nm were sequentially formed by vacuum deposition on a quartz substrate 1 cleaned with a detergent, pure water, and an organic solvent. A photoresist (AZ1370; available from Hoechst) was applied and baked to form a resist layer. Exposure and development were performed using a photomask to form the resist pattern of device electrodes 2 and 3. The unnecessary portions of the Pi/Ti film were removed by wet etching. Finally, the resist pattern was removed by an organic solvent to form the device electrodes 2 and 3. An interval L1 between the device electrodes was 20 μm, and an electrode length W2 was 300 μm (FIG. 14A).

Step-b

A Cr film (not shown) having a thickness of 50 nm was deposited by vacuum deposition. An opening portion conforming to an electroconductive film is formed by the conventional photolithography to form a Cr mask.

Figure 14B:
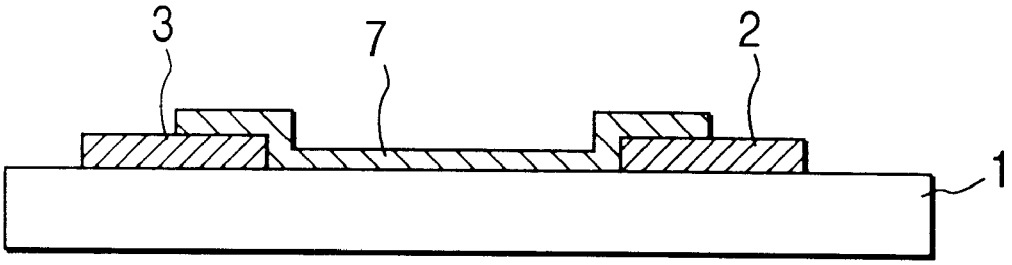
Figure 14C:
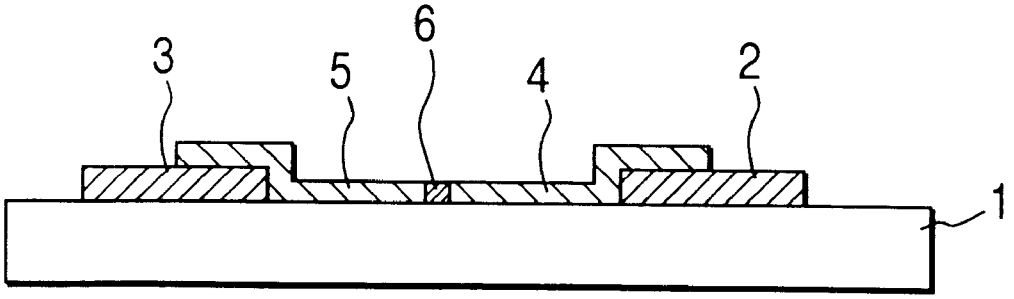

The solution of an organic Pd compound (CCP-4230; available from Okuno Seiyaku K.K.) was applied, heated and baked at 310° C. in an atmosphere to form a thin film formed of fine particles whose principal ingredient was palladium oxide (PdO). The Cr mask was removed by wet etching and lifted off to form an electroconductive film 7 having a desired pattern. A resistance value Rs of the electroconductive film was $4.0\times10^4$ Ω/□ (FIG. 14B).

Step-c

Figure 15A:
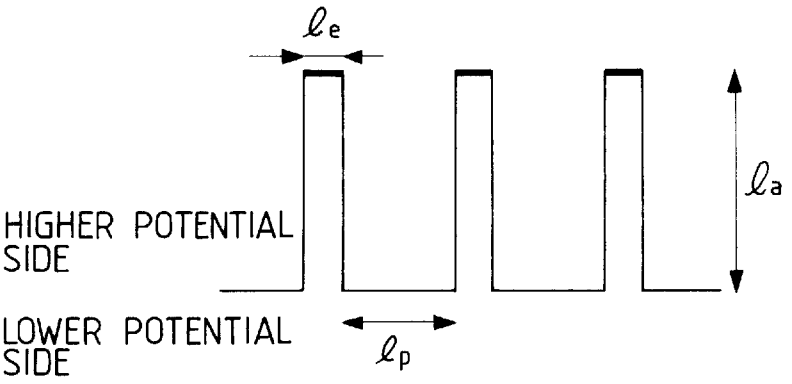
FIGS. 15A, 15B, 15C and 15D are views showing examples of the surface-conduction electron-emitting device of the present invention.

The device was set in a focused ion beam processing apparatus (FIB), and a desired portion of the electroconductive film was removed by sputtering using the FIB, thereby forming an insulated region having a shape shown in FIG. 15A. In this case, $l_e$ was 5 μm, $l_p$ was 9 μm, and $l_a$ was 10 μm.

The width of the insulated region was 40 nm at portions (portions indicated by thick lines in FIG. 15A) projecting to the higher potential side and 1 μm at other portions (portions indicated by thin lines in FIG. 15A). This is because only the portions projecting to the higher potential side are used as electron-emitting portions.

Step-d

Figure 2:
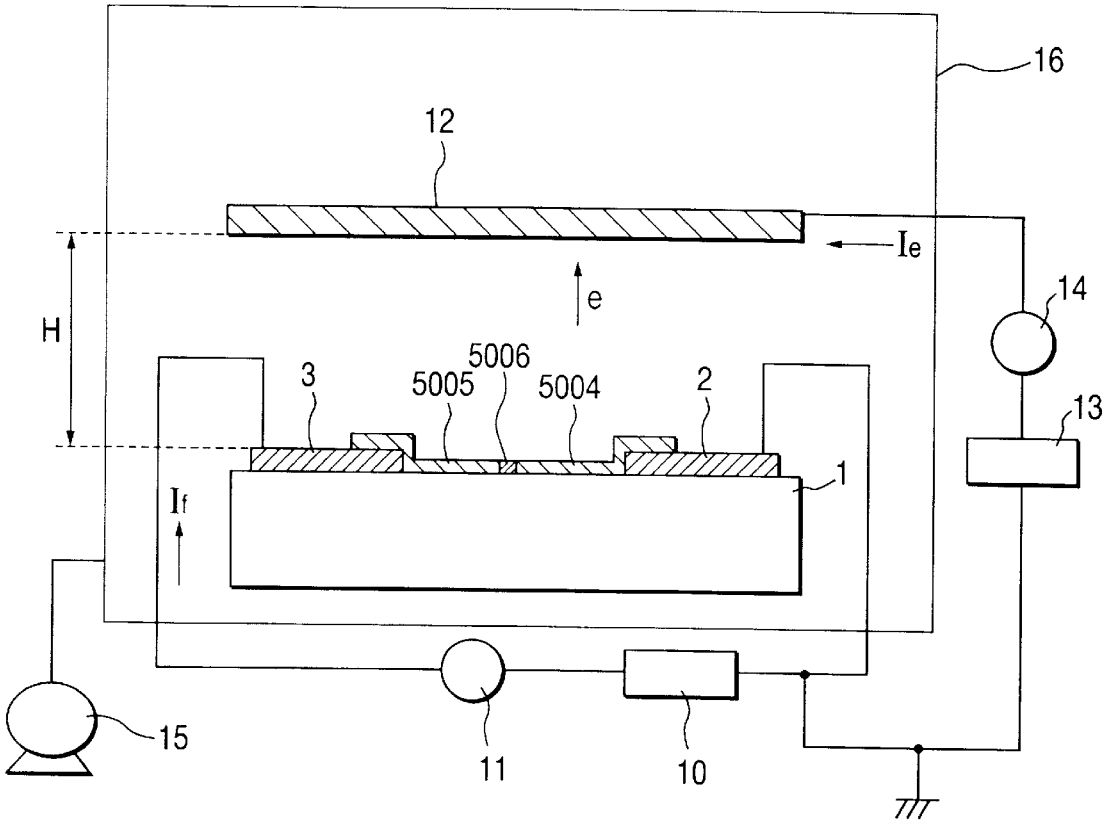
FIG. 2 is an explanatory view of an electron-emitting apparatus using the conventional surface-conduction electron-emitting device.
Figure 3A:
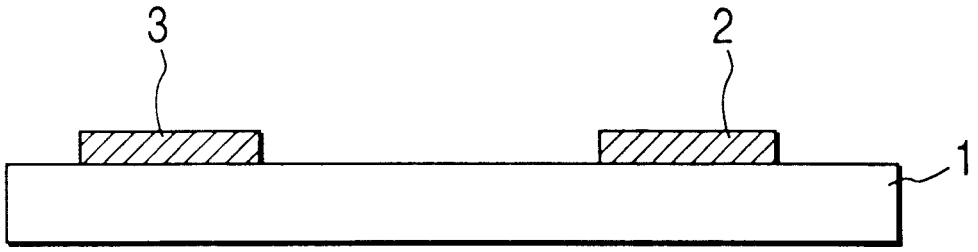
FIGS. 3A, 3B and 3C are views for explaining a method of manufacturing the conventional surface-conduction electron-emitting device.
Figure 3B:
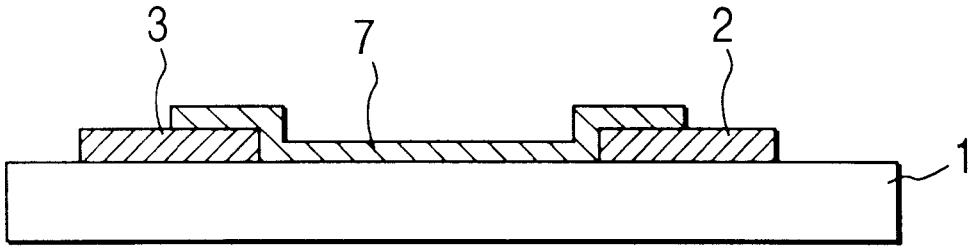
Figure 3C:
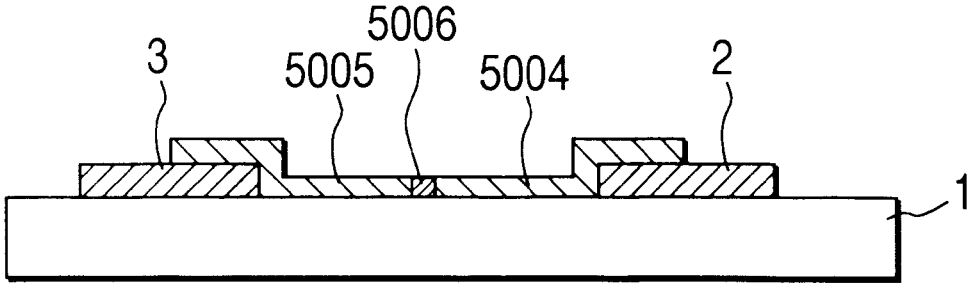
Figure 4:
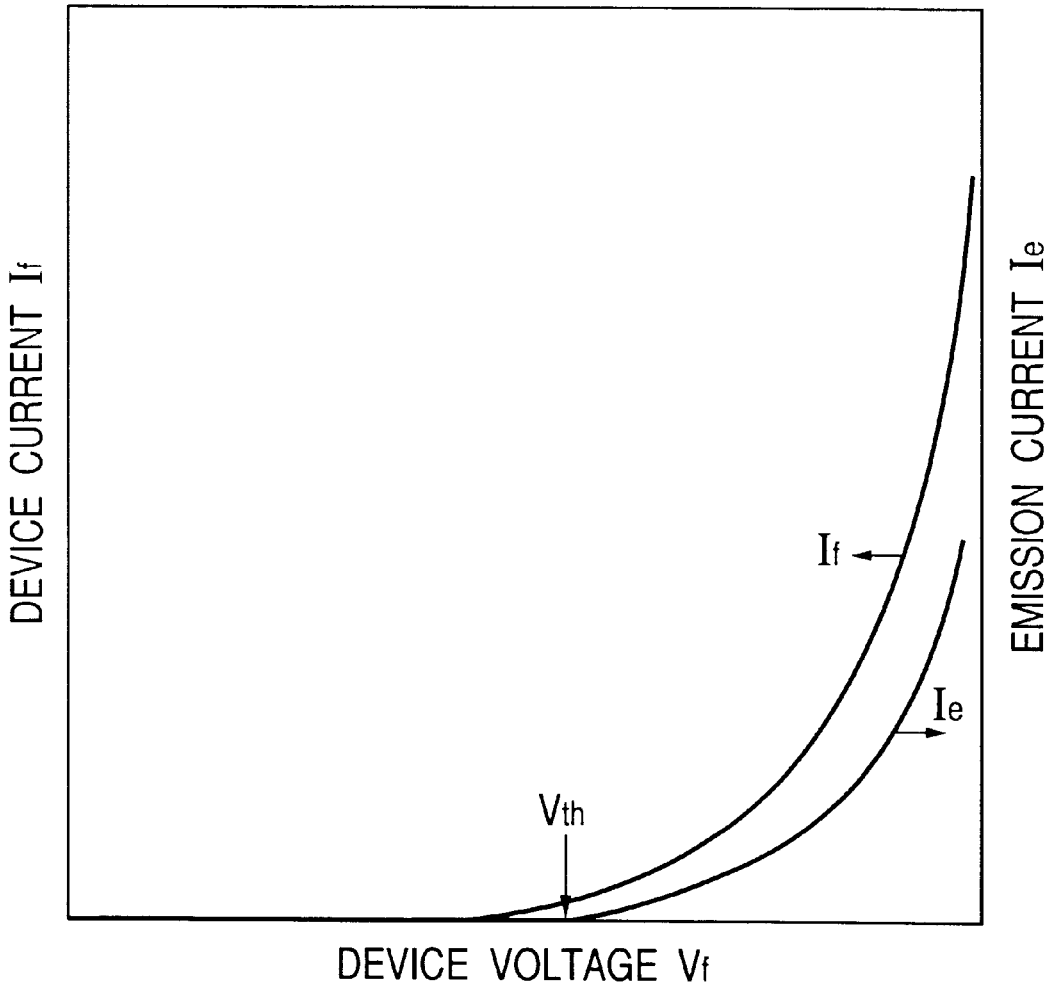
FIG. 4 is a graph showing the current characteristics of the electron-emitting apparatus using the conventional surface-conduction electron-emitting device.
Figure 5A:
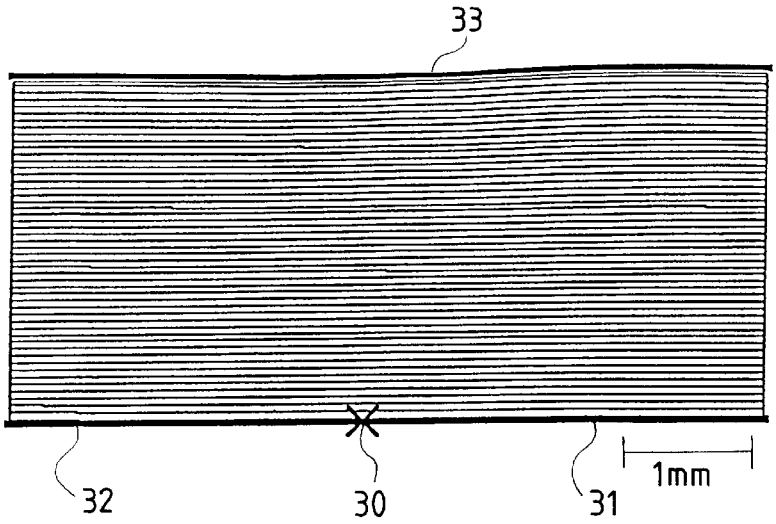
FIGS. 5A, 5B and 5C are views showing the characteristic potential distributions in the electron-emitting apparatus using the conventional surface-conduction electron-emitting device.
Figure 5B:
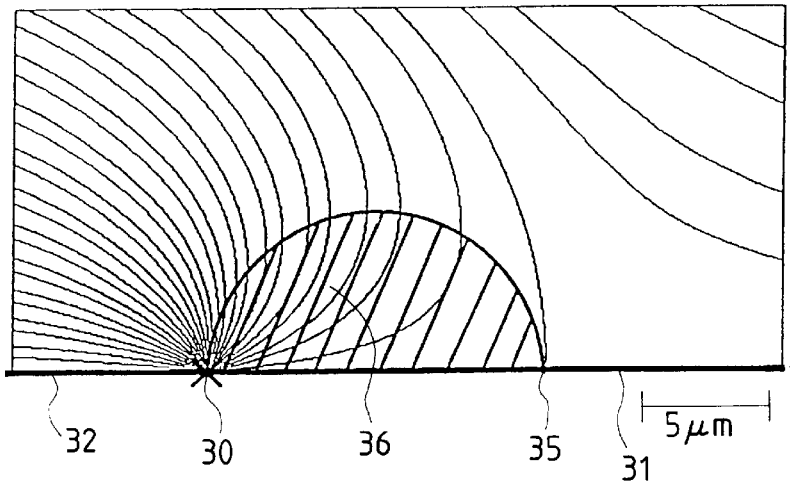
Figure 5C:
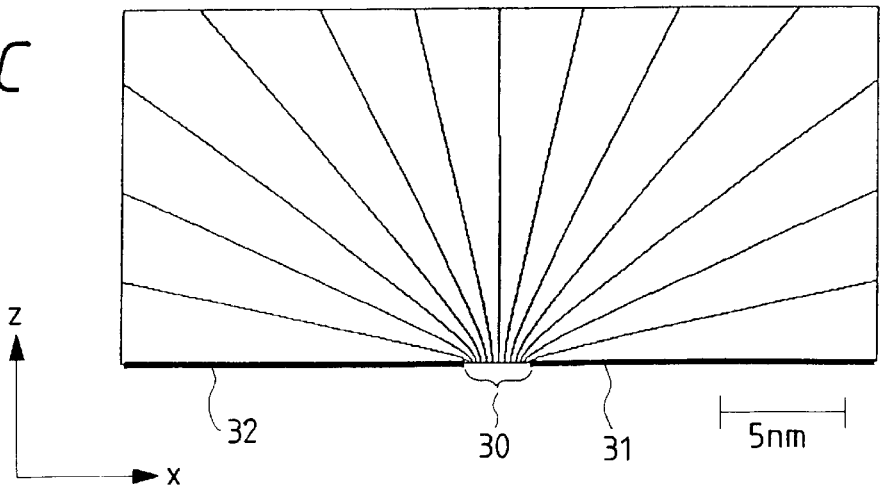
Figure 6:
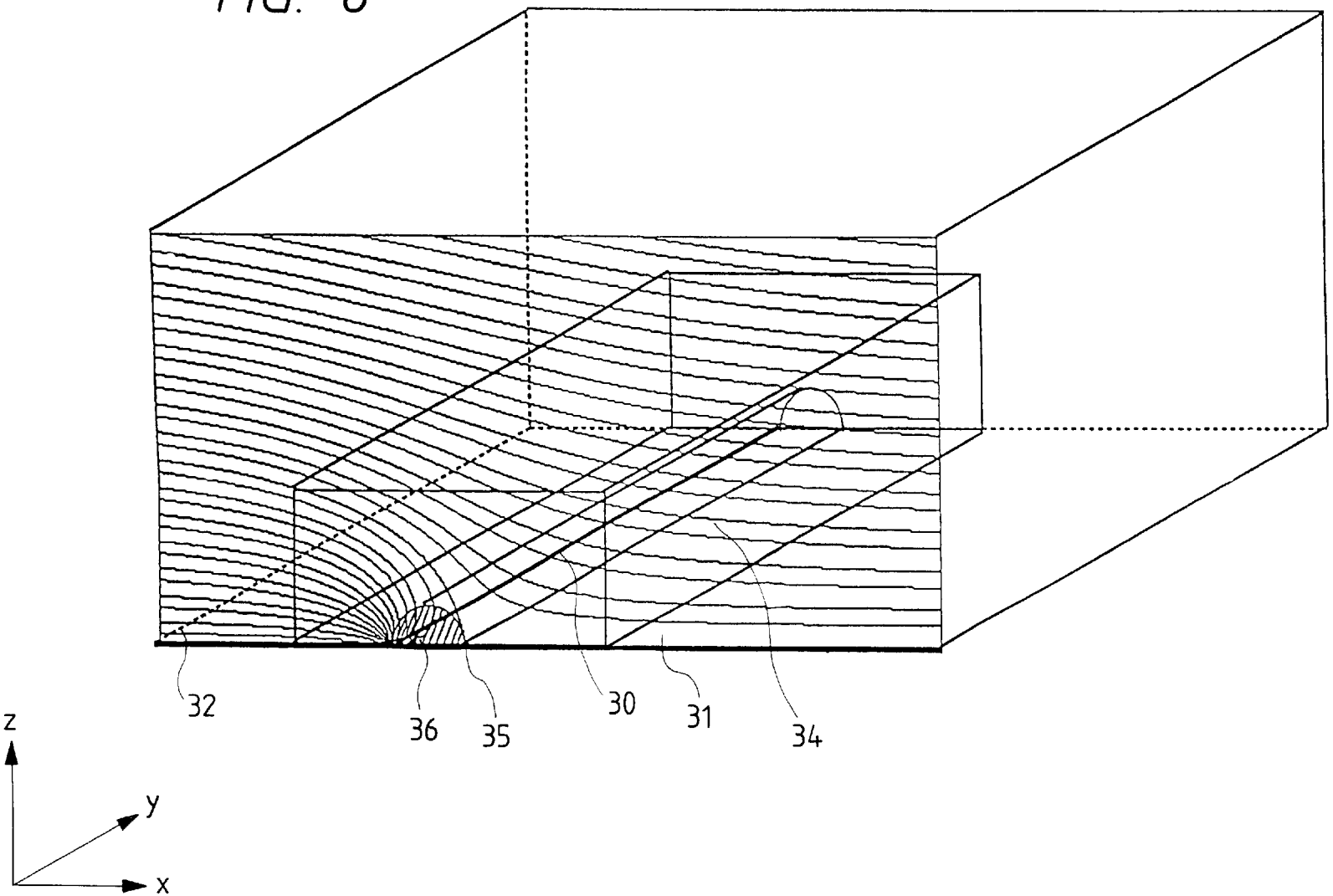
FIG. 6 is a perspective view showing the characteristic potential distribution in the electron-emitting apparatus using the conventional surface-conduction electron-emitting device.
Figure 7:
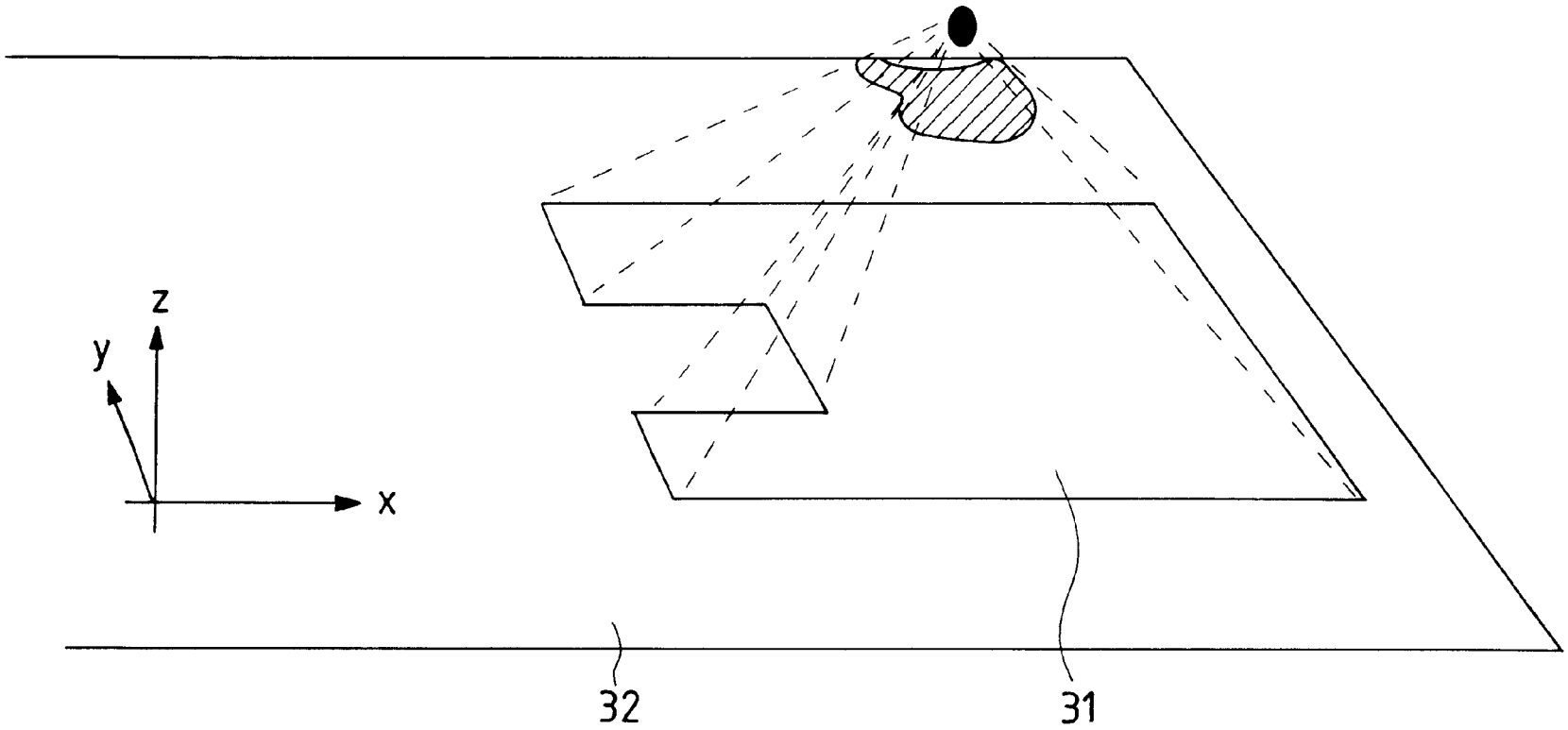
FIG. 7 is an explanatory view of the potential distribution with respect to a potential designation boundary binarized in a plane.
Figures 8A, 8B, 8C, 8D:
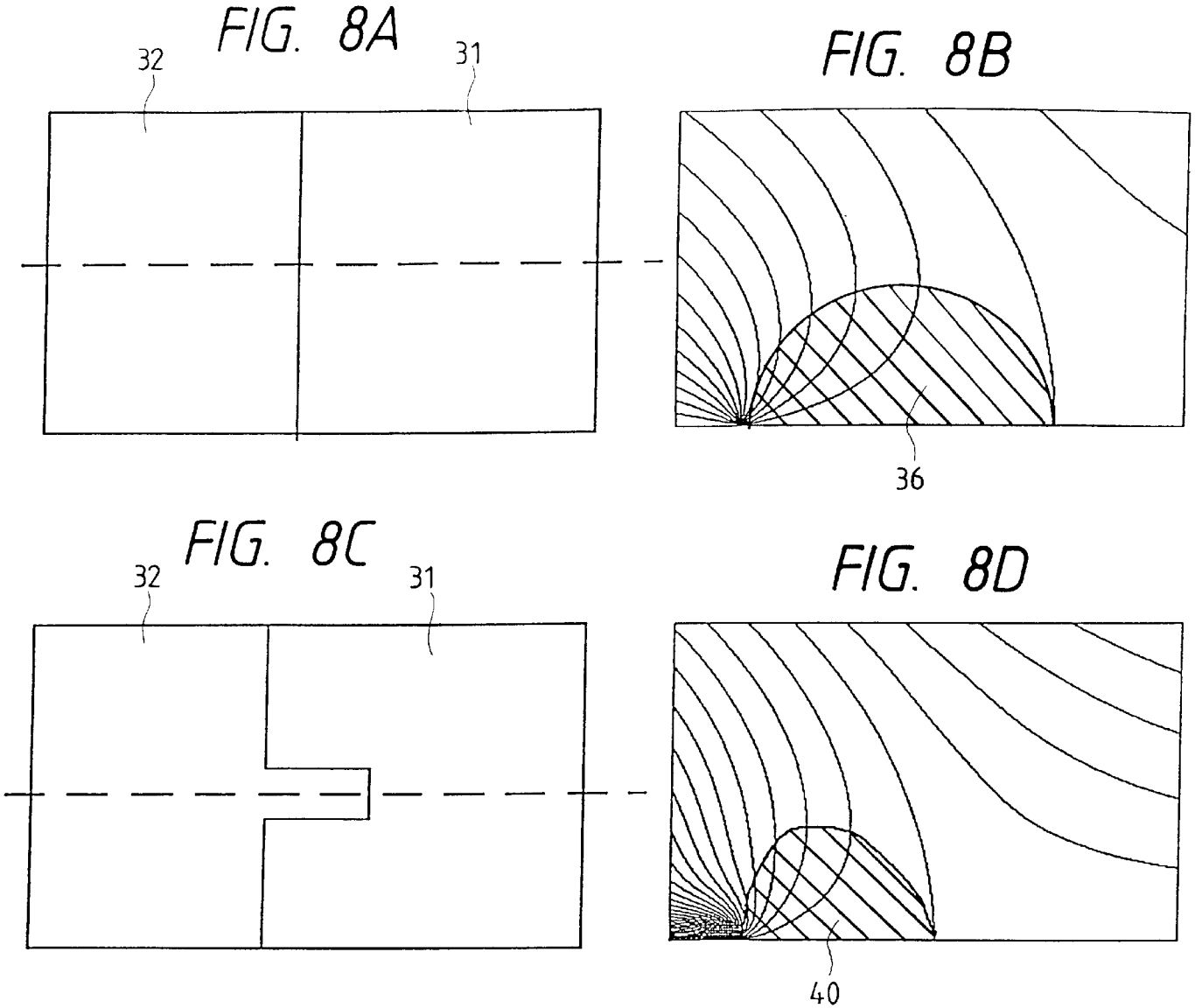
FIGS. 8A, 8B, 8C and 8D are views showing the characteristic potential distributions in the electron-emitting apparatus using surface-conduction electron-emitting devices having a linear fissure and a zigzag fissure.
Figure 9A:
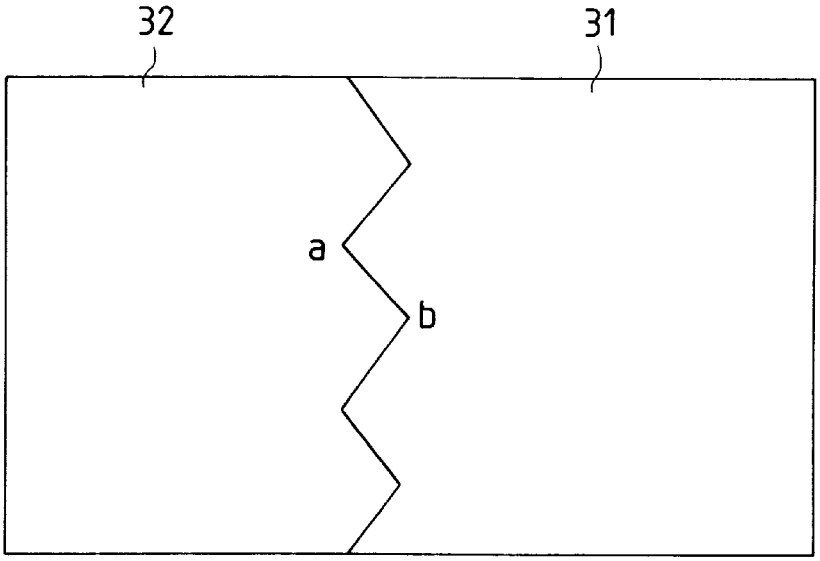
FIGS. 9A and 9B are explanatory views of the effect of the zigzag fissure in the conventional device.
Figure 9B:
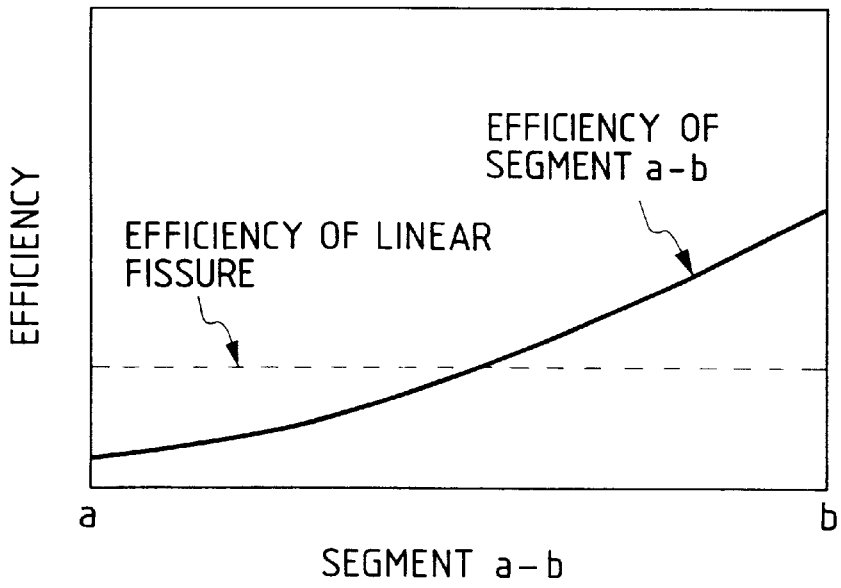
Figure 10A:
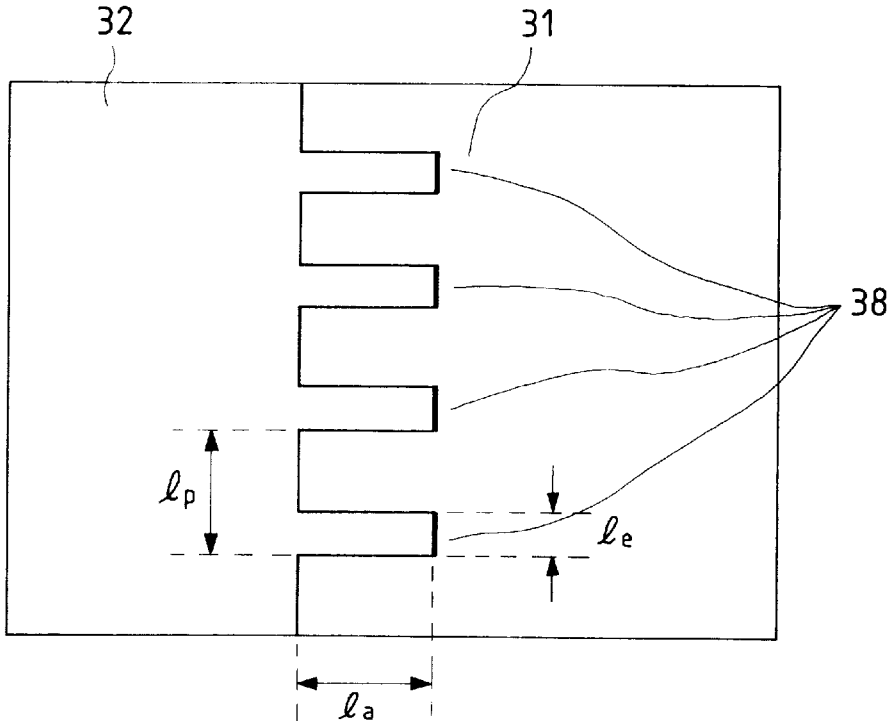
FIGS. 10A, 10B, 10C and 10D are views showing the dependency of a controlled zigzag fissure on parameters.
Figure 10B:
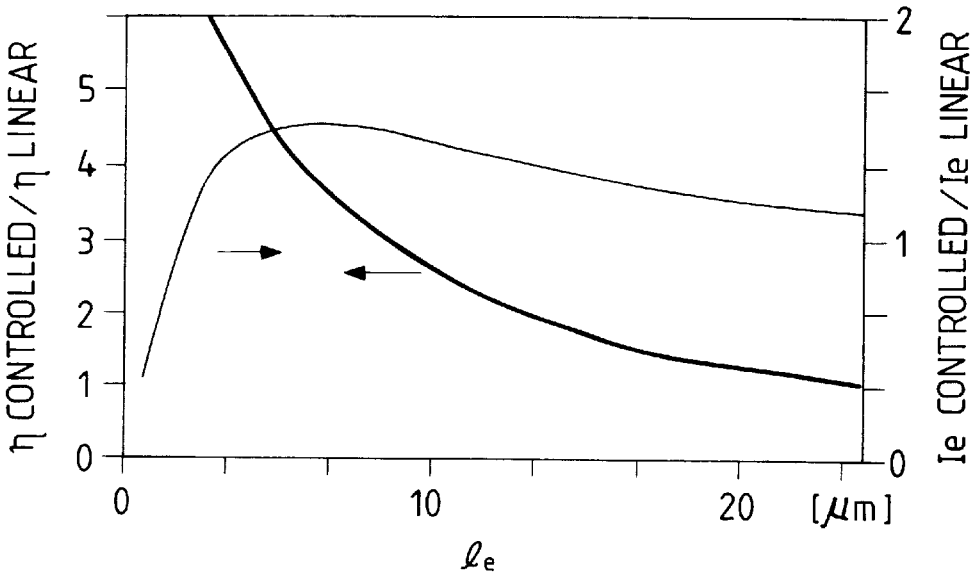
Figure 10C:
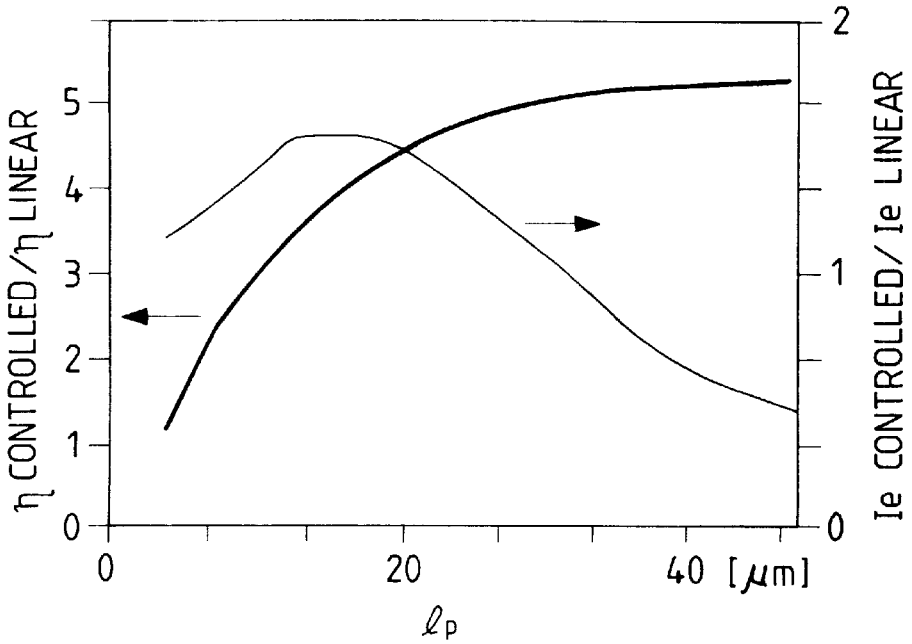
Figure 10D:
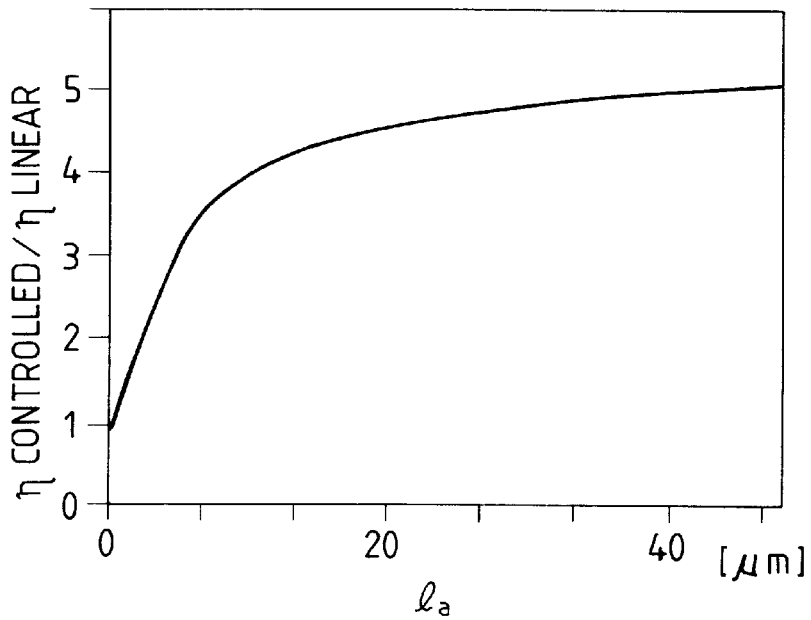
Figure 11A:
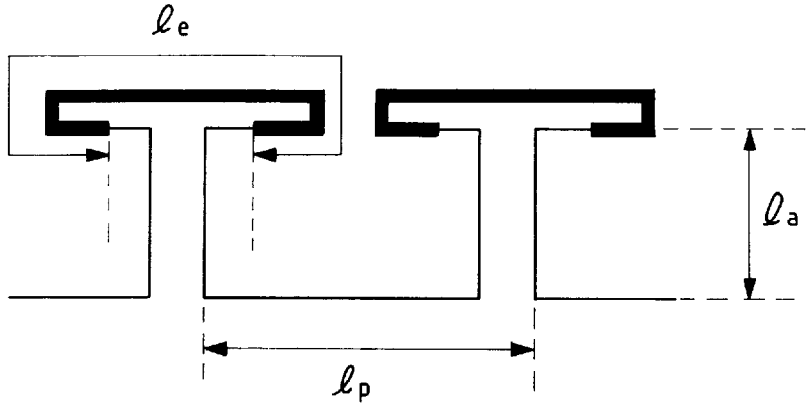
FIGS. 11A, 11B and 11C are views showing examples of special zigzag fissures.
Figure 11B:
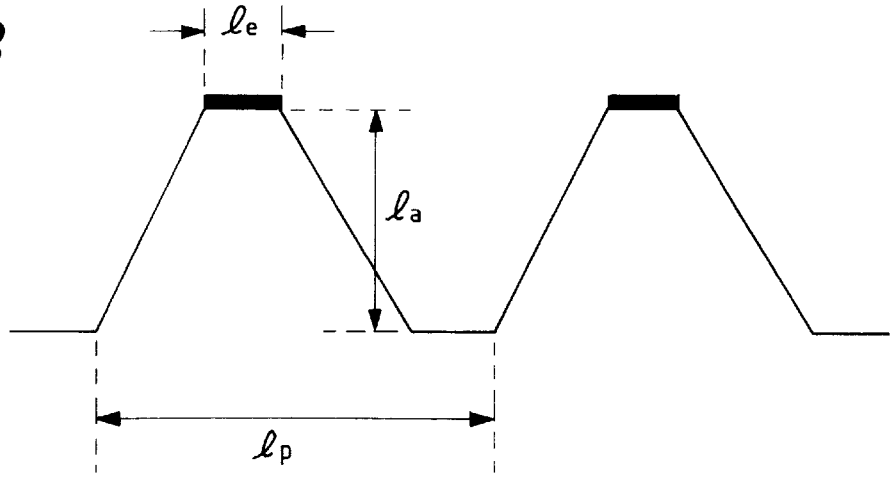
Figure 11C:
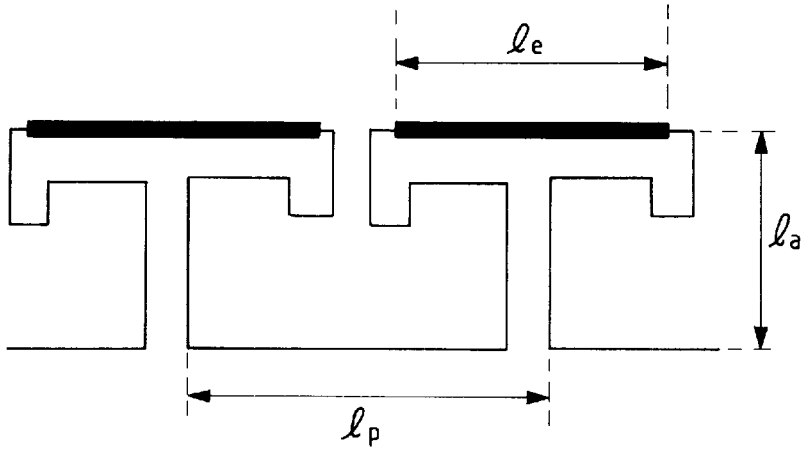
Figure 12A:
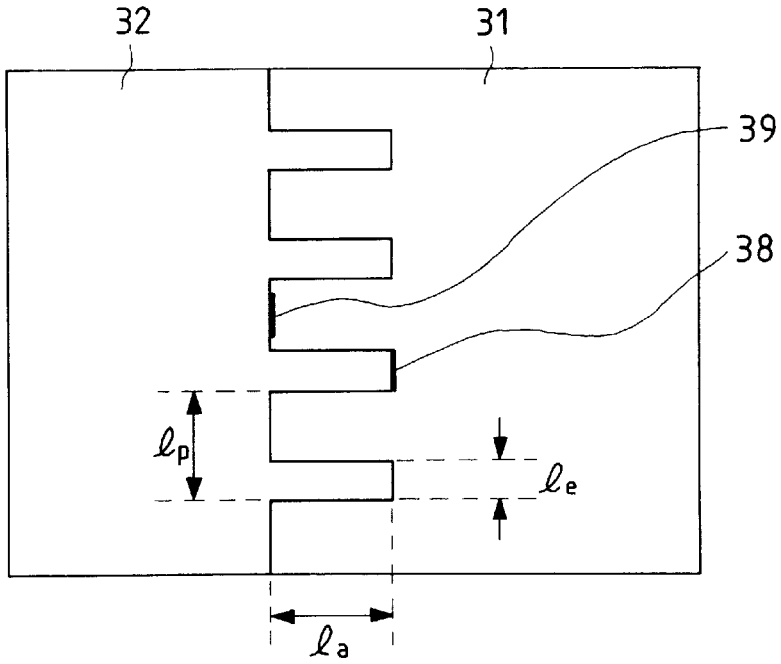
FIGS. 12A and 12B are views showing the dependency of the controlled zigzag fissure on $l_a$.
Figure 12B:
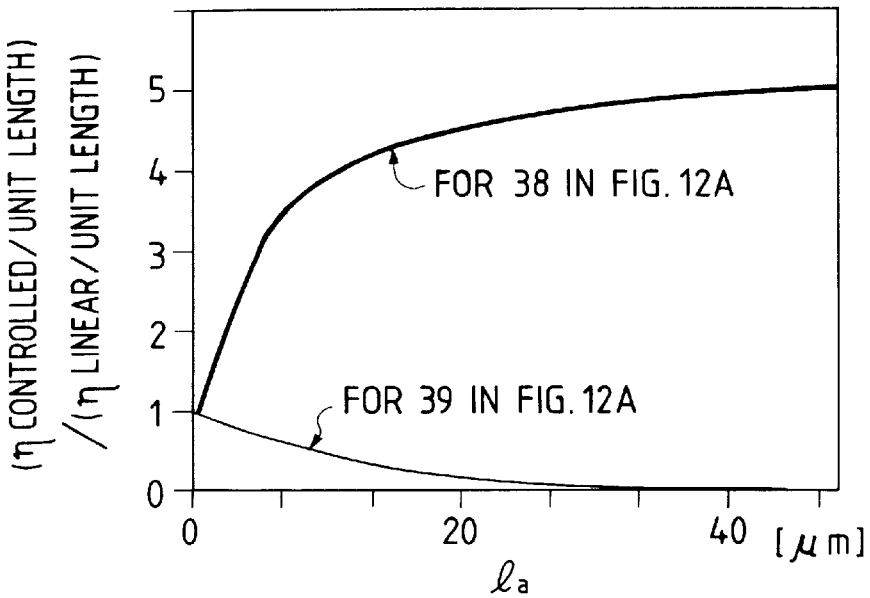
Figure 16:
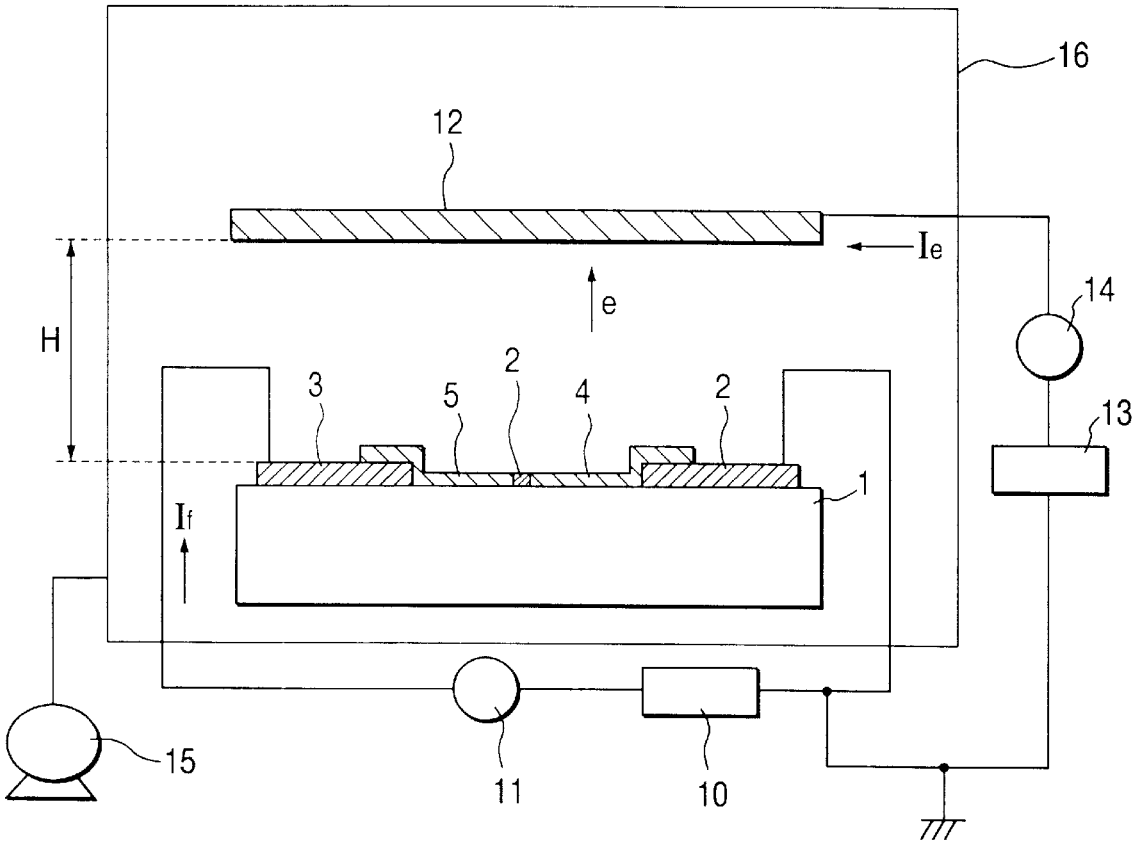
FIG. 16 is an explanatory view of an electron-emitting apparatus using the surface-conduction electron-emitting device of the present invention.

The device was set in a vacuum processing apparatus shown in FIG. 16, and activation processing was performed. The structure shown in FIG. 16 is the same as that shown in FIG. 2 of the prior art.

After a vacuum unit 16 was temporarily evacuated to a high vacuum by a vacuum pump 15, n-hexane was supplied, and the pressure was set to be $2.7\times10^{-2}$ Pa. A pulse voltage was applied across the device electrodes 2 and 3 to perform activation processing. At this time, a rectangular pulse was used. A pulse width T1 was 500 μsec, a pulse interval T2 was 10 msec, and the peak value was gradually increased from 10 V up to 18 V at a rate of 0.2 V/min.

Step-e

Supply of n-hexane was stopped. The vacuum unit 16 was evacuated by the vacuum pump 15 while heating the entire vacuum unit 16 to about 200° C. The pressure lowered to $4.2\times10^{-4}$ Pa after 24 hours. When the device was observed with a scanning electron microscope, a deposit was observed on and around the electron-emitting portions after step-d. From the finding about the conventional surface-conduction electron-emitting device, this deposit seems to be carbon and/or a carbon compound.

Comparative Example 1

After the same processes as in step-a and step-b of Example 1 were performed, energization forming was performed to form the electron-emitting portions.

Step-c'

The device was set in the vacuum processing apparatus shown in FIG. 16, and the vacuum vessel was evacuated by the vacuum pump 15, and the pressure was lowered to $2.0\times10^{-3}$ Pa or less.

A pulse voltage was applied across the device electrodes 2 and 3. The pulse was a triangular pulse. A pulse width T1 was 1 msec, and a pulse interval T2 was 10 msec. The pulse peak value was gradually increased from 0.1 V at a rate of 1 V/min. When the peak value reached 5 V, energization forming was ended because the device current abruptly decreased.

Thereafter, the same processes as in step-d and step-e as in Example 1 were performed.

The electron-emitting characteristics of the devices of Example 1 and Comparative Example 1 were measured by the apparatus shown in FIG. 16. A rectangular pulse having a pulse width T1 of 100 μsec, a pulse interval T2 of 10 msec, and a pulse peak value of 17 V was applied to the devices. A distance H between the device and the attracting electrode was 4 mm, and the potential of the attracting electrode was 1 kV. Table 1 shows the results. Note that η represents the electron-emitting efficiency ($I_e/I_f$).

TABLE 1

| | $I_f$ (mA) | $I_e$ (μA) | η (%) |
|---|---|---|---|
| Example 1 | 1.2 | 2.9 | 0.24 |
| Comparative Example 1 | 2.0 | 2.2 | 0.11 |

Comparative Example 2

An electroconductive film of fine PdO particles was formed by step-a and step-b, as in Example 1.

Step-c

A linear insulated region was formed by a focused ion beam apparatus. At this time, portions each having a length of 5 μm and a width of 40 nm were alternated with portions each having a width of 1 μm. The pitch was 9 μm. That is, the parameter $l_a$ of the device of Example 1 is set to be 0.

A device was prepared following the same procedures as in Example 1 except the above point, and the characteristics were measured.

The result was $I_f$=11 mA, $I_e$=1.1 μA, and η=0.10%.

EXAMPLE 2

A device was prepared following the same procedures as in Example 1 except that the insulated region was formed into the shape shown in FIG. 15A, $l_e$ was 5 μm, 9 μm was 9 μm, and $l_a$ was 5 μm.

EXAMPLE 3

A device was prepared following the same procedures as in Example 1 except that the insulated region was formed into the shape shown in FIG. 15A, $l_e$ was 5 μm, $l_p$ was 9 μm, and $l_a$ was 2 μm.

The electron-emitting characteristics of the devices were measured by the same method as in Example 1. Table 2 shows the results.

EXAMPLE 4

TABLE 2

| | $I_f$ (mA) | $I_e$ (μA) | η (%) |
|---|---|---|---|
| Example 1 | 1.2 | 2.9 | 0.24 |
| Example 2 | 1.2 | 2.0 | 0.17 |
| Example 3 | 1.1 | 1.4 | 0.13 |

A device was prepared following the same procedures as in Example 1 except that the insulated region was formed into the shape shown in FIG. 15A, $l_e$ was 10 μm, $l_p$ was 24 μm, and $l_a$ was 5 μm.

EXAMPLE 5

A device was prepared following the same procedures as in Example 1 except that the insulated region was formed into the shape shown in FIG. 15A, $l_e$ was 20 μm, $l_p$ was 44 μm, and $l_a$ was 5 μm.

The electron-emitting characteristics of the devices of Examples 4 and 5 were measured under the same conditions as in Example 1. Table 3 shows the results.

TABLE 3

| | $I_f$ (mA) | $I_e$ (μA) | η (%) |
|---|---|---|---|
| Example 4 | 1.2 | 1.8 | 0.15 |
| Example 5 | 1.2 | 1.6 | 0.13 |

EXAMPLE 6

A device was prepared following the same procedures as in Example 1 except that the insulated region was formed into the shape shown in FIG. 15A, and $l_e$ was 2 μm, $l_p$ was 7 μm, and $l_a$ was 20 μm.

Comparative Example 3

A device was prepared following the same procedures as in Example 1 except that the parameter $l_p$ in Example 6 was 4 μm.

EXAMPLE 7

Figure 15B:
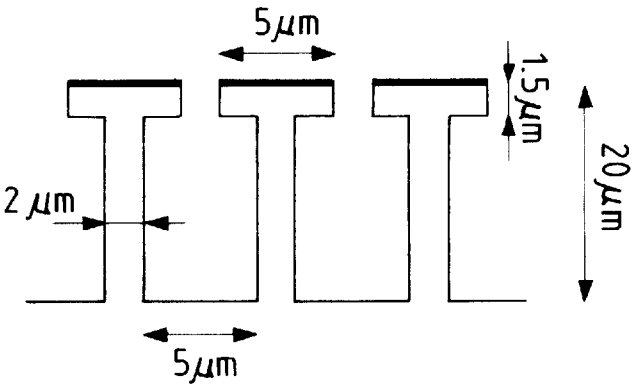

In Example 7 as well, a device was prepared following the same procedures as in Example 1 except that the insulated region patterned in step-c had a shape shown in FIG. 15B. The width of the insulated region was 40 nm at portions (portions indicated by thick lines in FIG. 15B) projecting to the higher potential side and 1 μm at other portions (portions indicated by thin lines in FIG. 15B). This is because only the portions projecting to the higher potential side are used as electron-emitting portions.

EXAMPLE 8

Figure 15C:
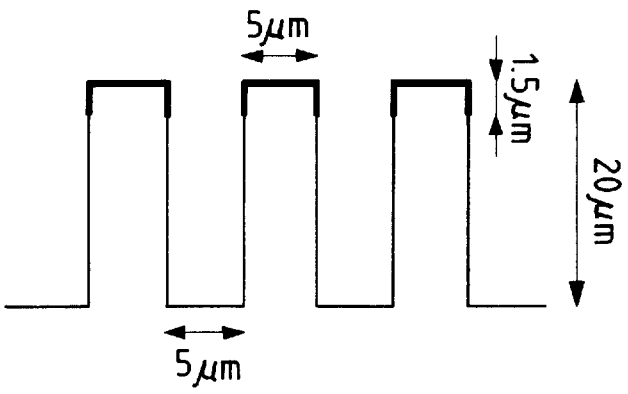

A device was prepared following the same procedures as in Example 6 except that the insulated region was formed into the shape shown in FIG. 15C.

EXAMPLE 9

Figure 15D:
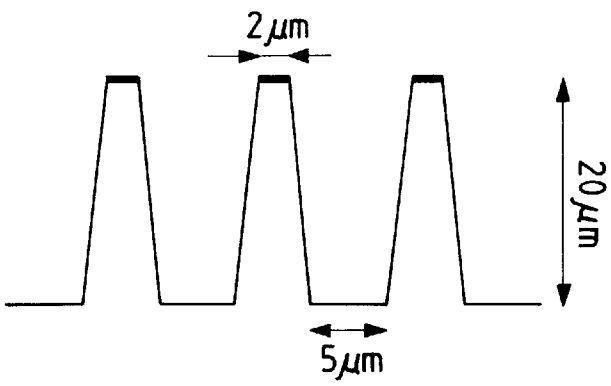

A device was prepared following the same procedures as in Example 6 except that the insulated region was formed into the shape shown in FIG. 15D.

The electron-emitting characteristics of the above devices were measured. The peak value of the applied pulse voltage was 17 V. The remaining conditions were the same as those in Example 1. Table 4 shows the results.

TABLE 4

| | $I_f$ (mA) | $I_e$ (μA) | η (%) |
|---|---|---|---|
| Example 6 | 1.0 | 6.5 | 0.65 |
| Example 7 | 1.0 | 6.7 | 0.67 |
| Example 8 | 1.2 | 6.1 | 0.51 |
| Example 9 | 1.1 | 5.1 | 0.46 |
| Comparative Example 3 | 1.8 | 2.0 | 0.11 |

EXAMPLE 10

Figure 17:
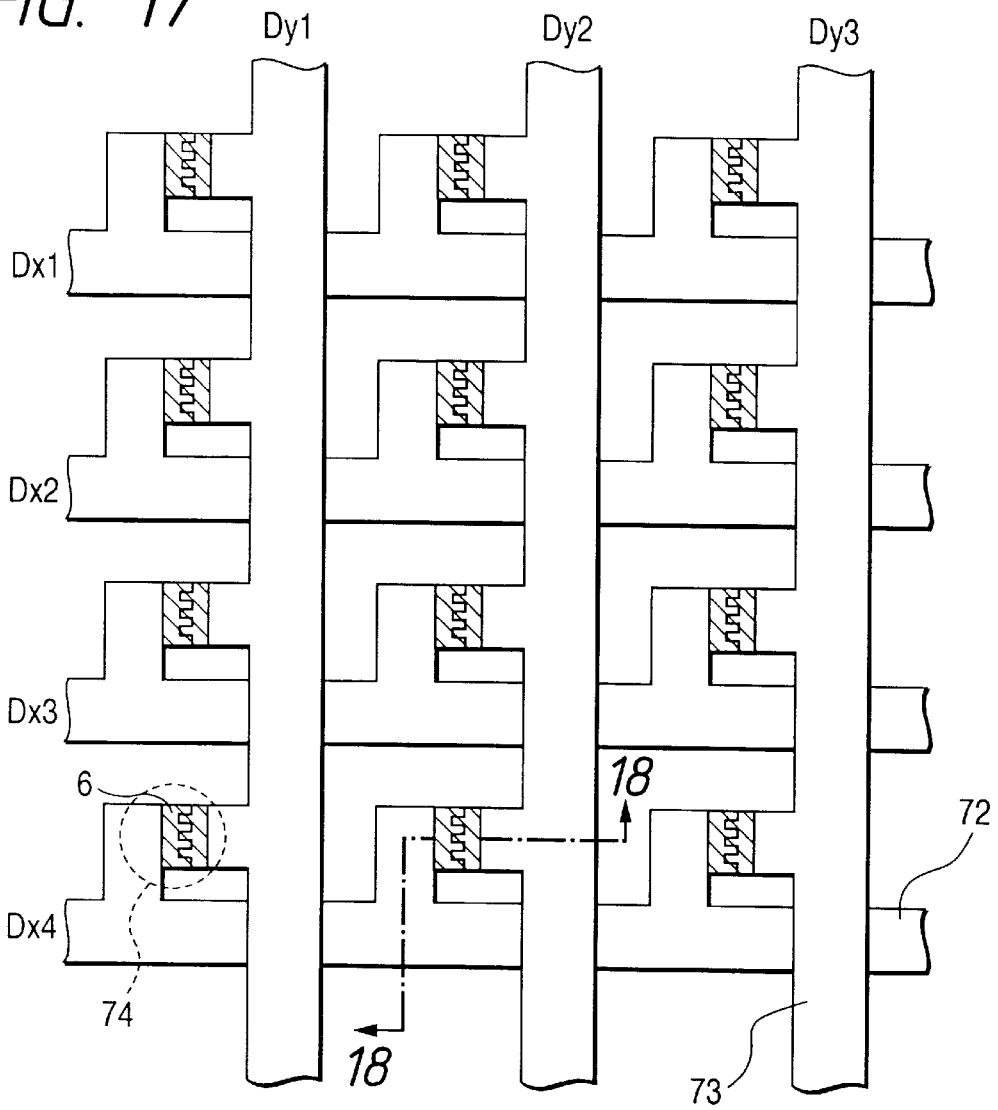
FIG. 17 is a partial plan view showing the structure of an electron source having a matrix array of the present invention.
Figure 18:
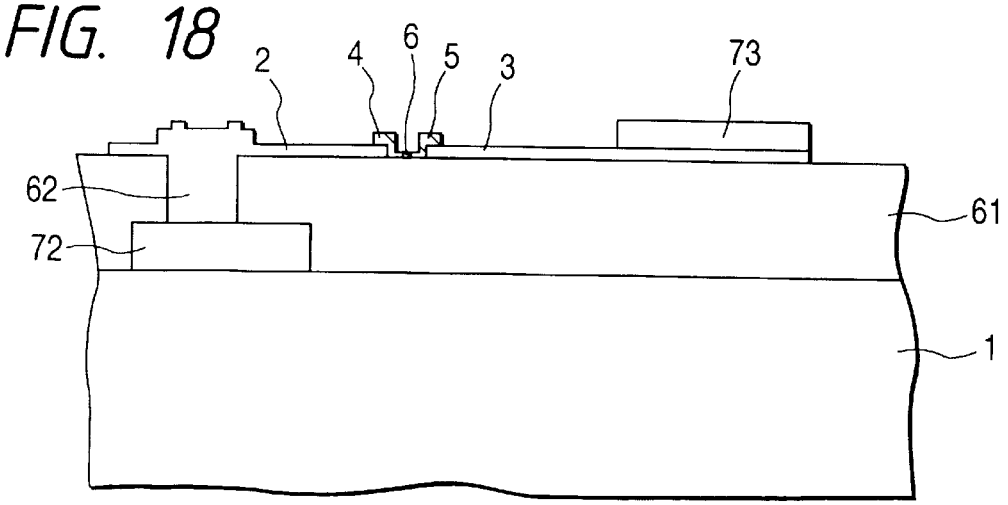
FIG. 18 is a sectional view showing the structure taken along a line 18—18in FIG. 17.

In this example, a lot of electron-emitting devices are arrayed in a simple matrix to form an electron source. FIG. 17 is a plan view of part of the electron source. FIG. 18 is a sectional view taken along a line 18—18 in FIG. 17.

The electron source includes a substrate 1, X-directional wires (also referred to as lower wires) 72, Y-directional wires (also referred to as upper wires) 73, device electrodes 2 and 3, electroconductive films 4 and 5, an insulating interlayer 61, and contact holes 62 for electrically connecting the positive device electrodes 2 to the lower wires 72.

A manufacturing method will be described below in detail with reference to FIGS. 19A to 19H.

Figure 19A:
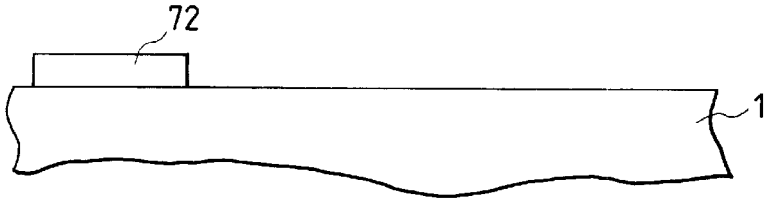
FIGS. 19A, 19B, 19C, 19D, 19E, 19F, 19G and 19H are sectional views for explaining a method of manufacturing the electron source having the matrix array of the present invention.

Step-A (FIG. 19A)

A silicon oxide film having a thickness of 0.5 μm was formed on a cleaned soda-lime glass by sputtering to prepare the substrate 1. Cr having a thickness of 5 nm and Au having a thickness of 600 nm were sequentially formed on the substrate 1 by vacuum deposition. A photoresist (AZ1370; available from Hoechst) was rotatably applied by a spinner and baked. Thereafter, the photomask image was exposed and developed to form the lower wires 72. The Au/Cr film was wet-etched to form the lower wires 72 having a desired shape.

Figure 19B:
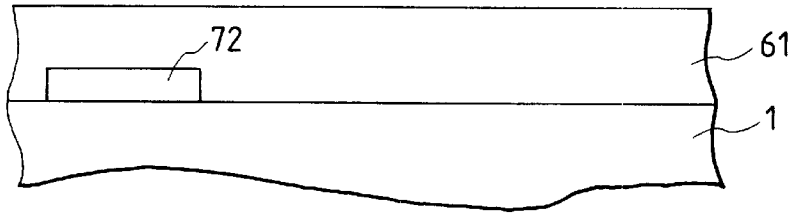

Step-B (FIG. 19B)

The insulating interlayer 61 formed of a silicon oxide film having a thickness of 1.0 μm was deposited by sputtering.

Figure 19C:
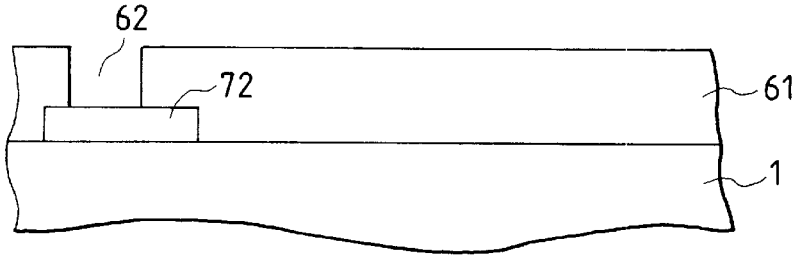

Step-C (FIG. 19C)

A photoresist pattern for forming the contact holes 62 was formed on the silicon oxide film deposited in step-B. The insulating interlayer 61 was etched using the photoresist pattern as a mask to form the contact holes 62. Etching was performed by RIE (Reactive Ion Etching) using $CF_4$ and $H_2$ gases.

Figure 19D:
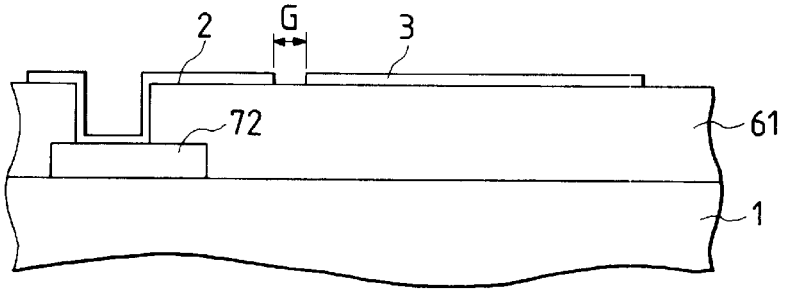

Step-D (FIG. 19D)

A pattern for forming the device electrodes 2 and device electrode gaps G was formed with a photoresist (RD-2000N-41; available from Hitachi Chemical., Ltd.) A Ti film having a thickness of 5 nm and an Ni film having a thickness of 100 nm were sequentially deposited by vacuum deposition. The photoresist was dissolved by an organic solvent. The Ni/Ti layer was lifted off to form the device electrodes 2 and 3 having a device electrode interval L1 of 20 μm and an electrode length W2 of 300 μm.

Figure 19E:
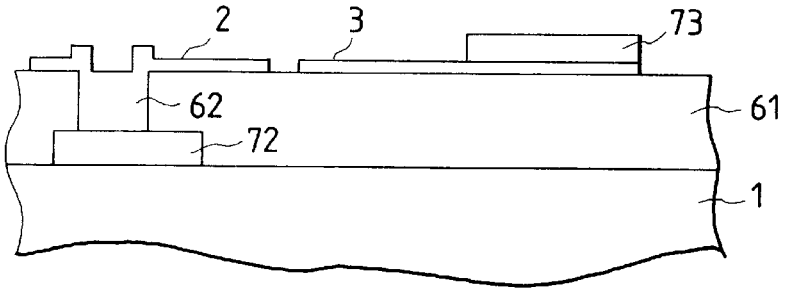

Step-E (FIG. 19E)

A photoresist pattern of the upper wires 73 was formed on the device electrodes 2 and 3. A Ti film having a thickness of 5 nm and an Au film having a thickness of 500 nm were sequentially deposited by vacuum deposition. The unnecessary portions were removed by lift-off to form the upper wires 73 having a desired shape.

Figure 19F:
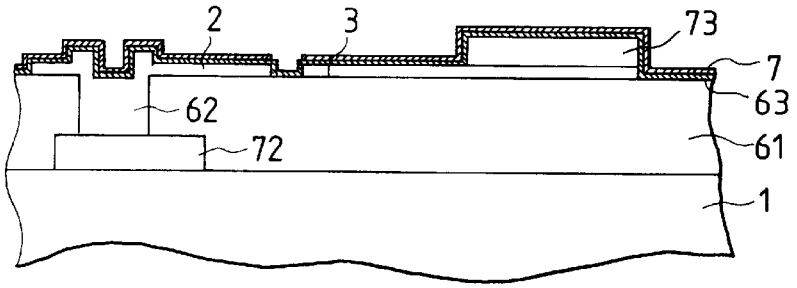

Step-F (FIG. 19F)

A Cr film 63 having a thickness of 30 nm was deposited by vacuum deposition and patterned to form openings corresponding to the shape of an electroconductive film 7. The solution of an organic Pd compound (CCP-4230; available from Okuno Seiyaku K.K.) was rotatably applied to the Cr film by a spinner, and a heating and baking treatment is performed at 300° C. for 12 minutes to form the electroconductive film 7 formed of fine PdO particles. The thickness of the electroconductive film 7 was 70 nm.

Figure 19G:
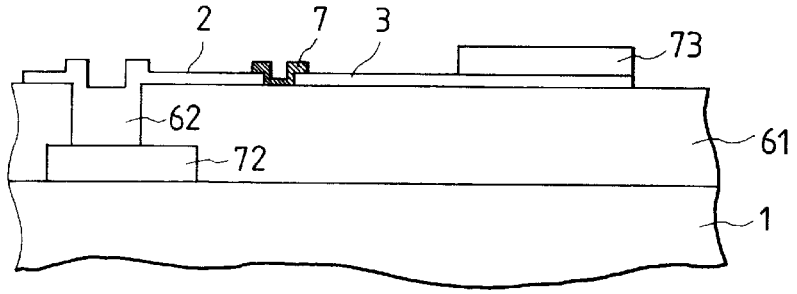

Step-G (FIG. 19G)

The Cr film 63 was wet-etched using an etchant and removed together with the unnecessary portions of the electroconductive film 7 formed of the fine PdO particles, thereby forming the electroconductive film 7 having a desired shape. The resistance value Rs was about $4\times10^4$ Ω/□.

Figure 19H:
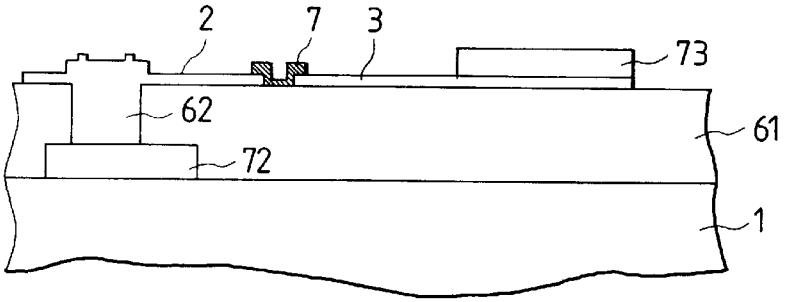

Step-H (FIG. 19H)

A resist pattern was formed in regions excluding the contact holes 62. A Ti film having a thickness of 5 nm and an Au film having a thickness of 500 nm were sequentially deposited by vacuum deposition. The unnecessary portions were removed by lift-off to bury the contact holes 62.

Step-I

The electron source substrate was set in an FIB processing apparatus to form an insulated region on the electroconductive films of the respective electron-emitting devices on the substrate, as in Example 1.

Figure 20:
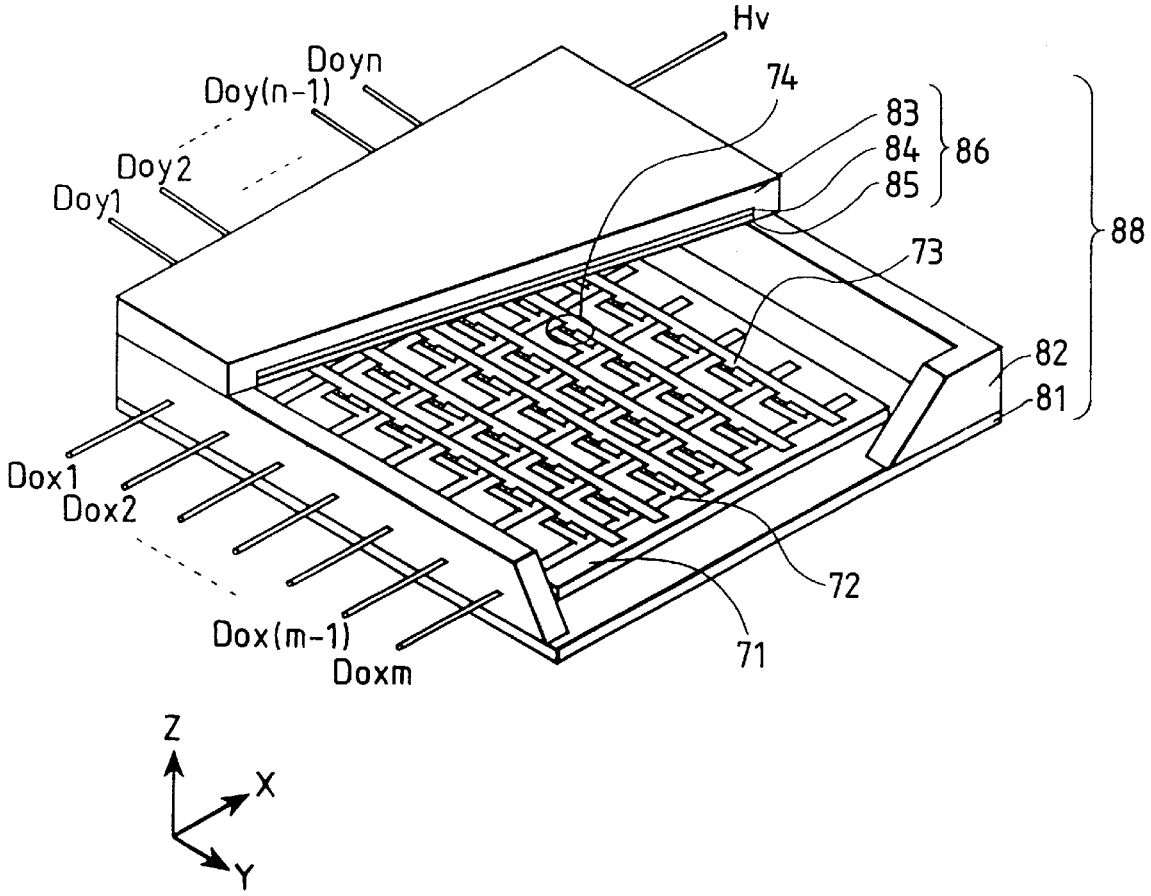
FIG. 20 is a perspective view showing the structure of an image-forming apparatus using the electron source having the matrix array of the present invention.

An image-forming apparatus using the electron source will be described with reference to FIG. 20.

An electron source substrate 71 was fixed on a rear plate 81. A face plate 86 (the face plate 86 is constituted by forming a phosphor film 84 and a metal back 85 on the inner surface of a glass substrate 83) was arranged at a portion 5 mm above the substrate 1 through a supporting frame 82. Frit glass was applied to the junction portions between the face plate 86, the supporting frame 82, and the rear plate 81. The resultant structure was baked in the atmosphere at 400° C. for about 10 minutes to effect sealing. The substrate 71 was also fixed to the rear plate 81 with frit glass. Referring to FIG. 20, the electron source includes electron-emitting devices 74, and the X- and Y-directional device wires 72 and 73.

In case of a monochromatic display, the phosphor film 84 consists of only a phosphor. In this example, however, striped phosphors were employed. First, black stripes were formed, and phosphors of the respective colors were applied to the gap portions between the black stripes to form the phosphor film 84. A material containing, as its principal component, popular graphite was used for the black stripes. A slurry method was used as a method of applying the phosphors to the glass substrate 83.

The metal back 85 is normally formed on the inner surface side of the phosphor film 84. The metal back was formed by depositing Al after the phosphor film was manufactured and performing a smoothing process (normally referred to as a "filming" process) for the inner surface of the phosphor film.

To increase the conductivity of the phosphor film 84, a transparent electrode (not shown) may be formed on the outer surface side of the phosphor film 84 of the face plate 86. In this example, however, the transparent electrode was omitted because a sufficient conductivity was obtained only with the metal back.

In the above-described sealing processing, sufficient alignment was performed because the phosphors of the respective colors must be made to correspond to the electron-emitting devices in case of a color display.

Figure 21:
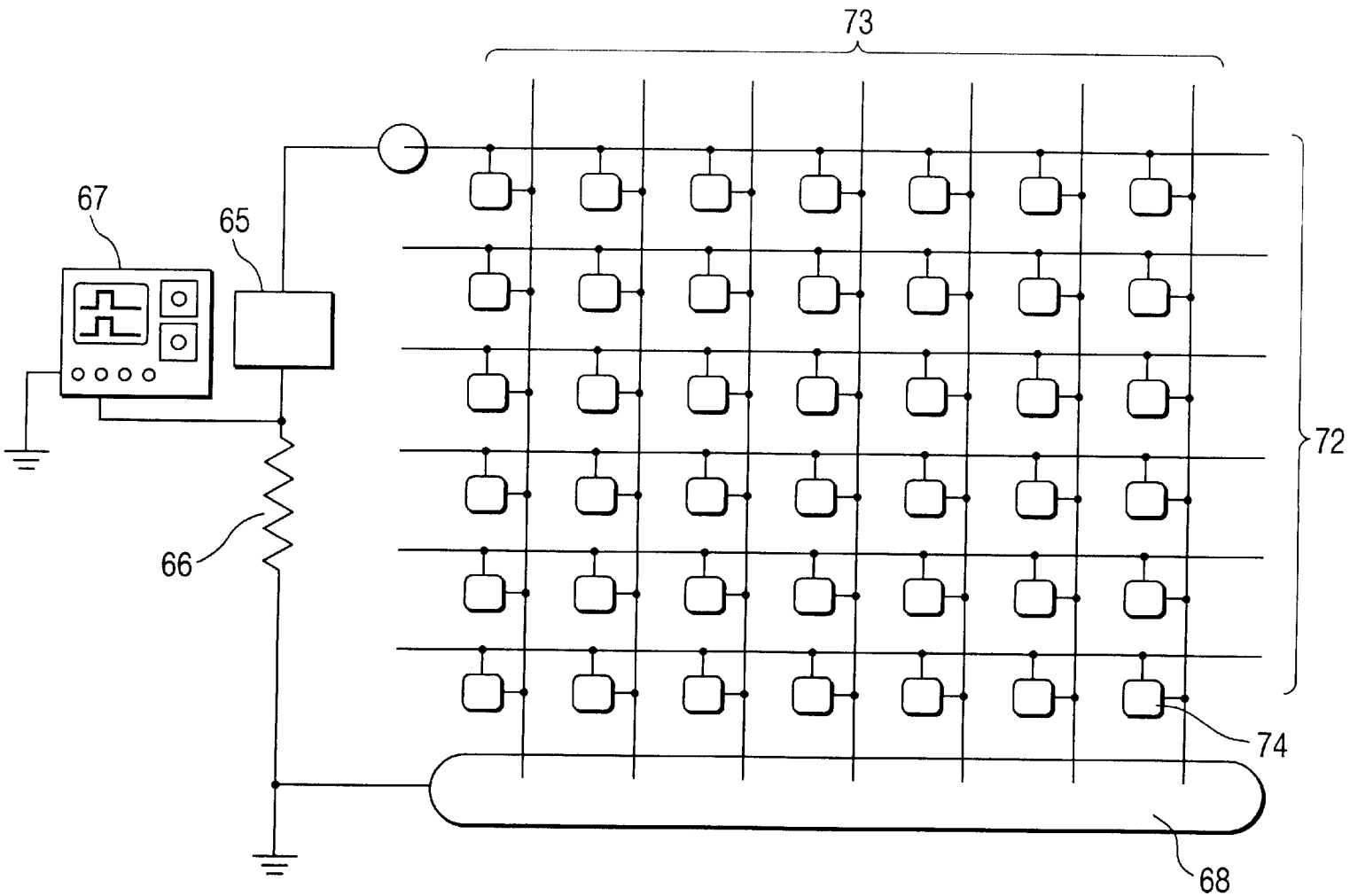
FIG. 21 is a schematic view showing wiring for the activation processing in manufacturing the electron source having the matrix array of the present invention and the image-forming apparatus.

The glass container of the image-forming apparatus completed in the above manner was evacuated by a vacuum pump through an exhaust tube (not shown) to about $10^{-4}$ Pa. Thereafter, n-hexane was supplied, and the pressure in the container was set to be $2.7\times10^{-2}$ Pa. As shown in FIG. 21, the Y-directional wires were commonly connected, and activation processing was performed in units of lines. The apparatus includes a common electrode 68 to which the Y-directional wires 73 are commonly connected, a power supply 65, a current measurement resistor 66, and an oscilloscope 67 for monitoring the current.

The applied pulse voltage is the same as in Example 1. After completion of activation processing, supply of n-hexane was stopped. The exhaust unit was switched to the ion pump to evacuate the glass container to a pressure of $4.2\times10^{-5}$ Pa while heating the entire glass container by a heater.

In this example, the wires were arrayed in a matrix. However, even when a ladder-shaped array is used, and a grid electrode for modulation is arranged, an apparatus having the same function as described above can be formed.

The matrix was driven to confirm that the display function normally functioned, and the characteristics were stable. Thereafter, the exhaust tube (not shown) was heated by a gas burner to seal the exhaust tube, thereby completely sealing the vacuum vessel. Finally, to maintain the degree of vacuum after sealing, a getter treatment was performed by a high-frequency heating method.

In the resultant image-forming apparatus of the present invention, scanning signals and modulation signals were applied from a signal generation means (not shown) to the respective electron-emitting devices through external terminals Dox1 to Doxm and external terminals Doy1 to Doyn to cause the electron-emitting devices to emit electrons. A high voltage of 5.0 kV was applied to the metal back 85 or a transparent electrode (not shown) through a high-voltage terminal Hv to accelerate the electron beam and bombard the phosphor film 84 with the electron beam, thereby exciting the phosphor film 84 and causing the phosphor film 84 to emit light. With this operation, an image was displayed.

Figure 22:
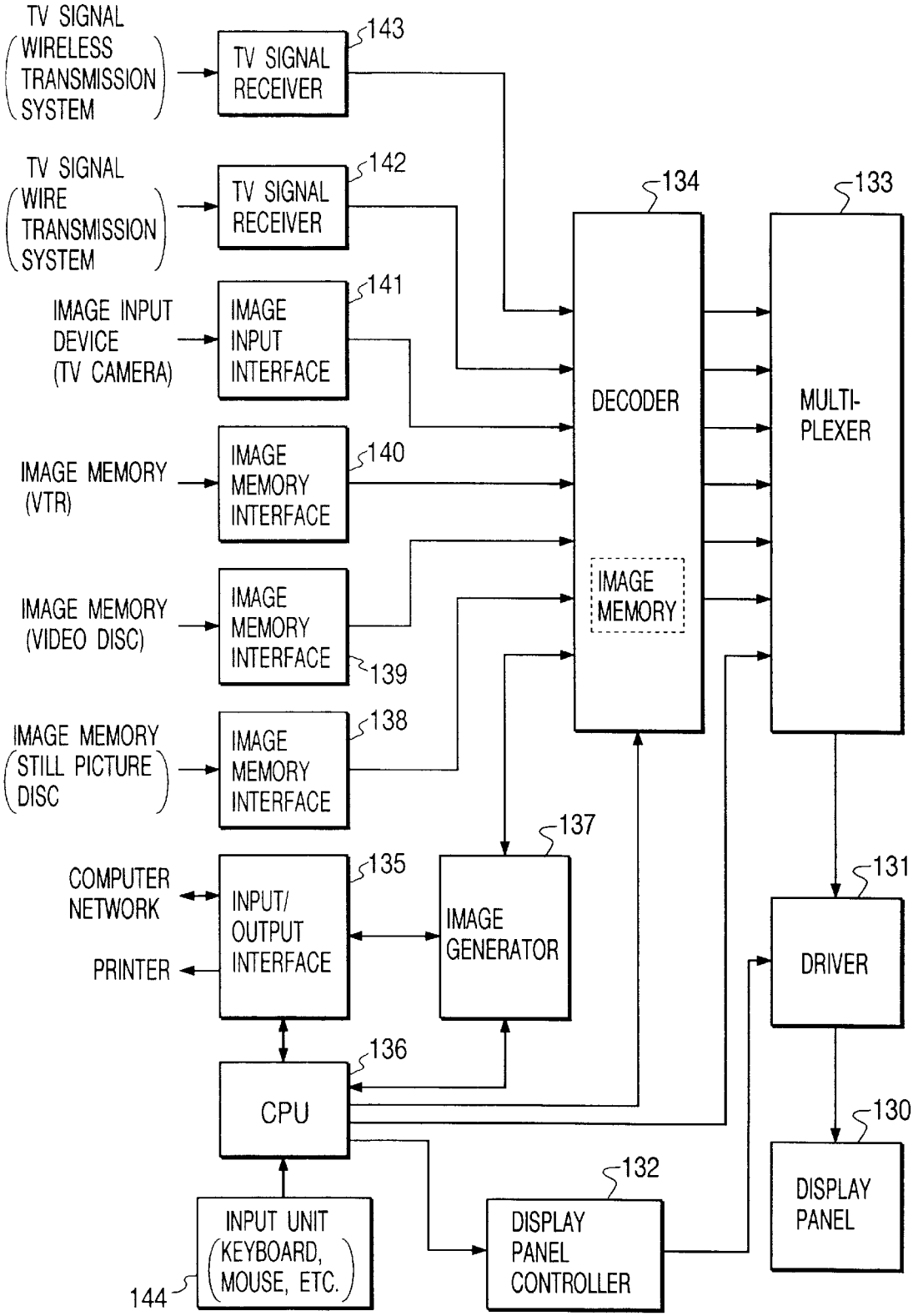
FIG. 22 is a block diagram showing an image display system using the image-forming apparatus of the present invention.

FIG. 22 is a block diagram showing an example of a display apparatus which can display image information supplied from various image information sources represented by TV broadcasting on the image-forming apparatus (display panel) of Example 10. The display apparatus includes a display panel 130, a driver 131 for the display panel, a display panel controller 132, a multiplexer 133, a decoder 134, an input/output interface 135, a CPU 136, an image generator 137, image memory interfaces 138, 139, and 140, an image input interface 141, TV signal receivers 142 and 143, and an input unit 144. (When the display apparatus receives a signal such as a TV signal including both video information and audio information, video images and sound are reproduced simultaneously, as a matter of course. A description of circuits and speakers which are associated with reception, separation, processing, and storage of audio information will be omitted because these components are not directly related to the features of the present invention).

The functions of the respective components will be described below in accordance with the flow of an image signal.

The TV signal receiver 143 is a circuit for receiving TV signals transmitted via a radio transmission system such as electric wave transmission or space optical communication. The standards of the TV signals to be received are not particularly limited, and any one of the NTSC, PAL, and SECAM standards may be used. In addition, a TV signal comprising a larger number of scanning lines (e.g., so-called high-definition TV represented by the MUSE standard) is a preferable signal source for utilizing the advantageous features of the display panel applicable to a large display screen and numerous pixels. The TV signal received by the TV signal receiver 143 is output to the decoder 134.

The TV signal receiver 142 is a circuit for receiving TV signals transmitted via a cable transmission system such as a coaxial cable system or an optical fiber system. Like the TV signal receiver 143, the standards of the TV signals to be received are not particularly limited. The TV signal received by the TV signal receiver 142 is also output to the decoder 134.

The image input interface 141 is a circuit for receiving an image signal supplied from an image input device such as a TV camera or an image reading scanner. The received image signal is output to the decoder 134.

The image memory interface 140 is a circuit for receiving an image signal stored in a video tape recorder (to be abbreviated to a VTR hereinafter). The received image signal is output to the decoder 134.

The image memory interface 139 is a circuit for receiving an image signal stored in a video disk. The received image signal is output to the decoder 134.

The image memory interface 138 is a circuit for receiving an image signal from a device such as a still image disk which stores still image data. The received still image data is input to the decoder 134.

The input/output interface 135 is a circuit for connecting the display apparatus to an external computer, a computer network, or an output device such as a printer. The input/output interface 135 not only inputs/outputs image data or character/graphic information but also can input/output control signals or numerical data between the CPU 136 of the display apparatus and an external device, as needed.

The image generator 137 is a circuit for generating display image data on the basis of image data or character/graphic information externally input through the input/output interface 135 or image data or character/graphic information output from the CPU 136. The image generator 137 incorporates circuits necessary for generating image data, including a programmable memory for storing image data or character/graphic information, a read only memory which stores image patterns corresponding to character codes, and a processor for performing image processing.

The display image data generated by the image generator 137 is output to the decoder 134. However, the display image data can be output to an external computer network or a printer through the input/output interface 135, as needed.

The CPU 136 mainly performs an operation associated with operation control of the display apparatus, and generation, selection, and editing of a display image.

For example, a control signal is output to the multiplexer 133, thereby appropriately selecting or combining image signals to be displayed on the display panel. At this time, a control signal is generated to the display panel controller 132 in accordance with the image signal to be displayed, thereby appropriately controlling the operation of the display apparatus, including the frame display frequency, the scanning method (e.g., interlaced scanning or non-interlaced scanning), and the number of scanning lines in one frame.

In addition, the CPU 136 directly outputs image data or character/graphic information to the image generator 137, or accesses an external computer or memory through the input/output interface 135 to input image data or character/graphic information.

The CPU 136 may operate for other purposes. For example, the CPU 136 may be directly associated with a function of generating or processing information, like a personal computer or a wordprocessor. Alternatively, as described above, the CPU 136 may be connected to an external computer network through the input/output interface 135 to cooperate with the external device in, e.g., numerical calculation.

The input unit 144 is used by the user to input instructions, program, or data to the CPU 136. In addition to a keyboard and a mouse, various input devices such as a joy stick, a bar-code reader, or a speech recognition device can be used.

The decoder 134 is a circuit for decoding various image signals input from the circuits 137 to 143 into three primary color signals, or a luminance signal and I and Q signals. As indicated by a dotted line in FIG. 22, the decoder 134 preferably incorporates an image memory such that TV signals such as MUSE signals which require an image memory for decoding can be processed. An image memory facilitates display of a still image. In addition, the image memory enables facilitation of image processing including thinning, interpolation, enlargement, reduction, and synthesizing, and editing of image data in cooperation with the image generator 137 and the CPU 136.

The multiplexer 133 appropriately selects a display image on the basis of a control signal input from the CPU 136. More specifically, the multiplexer 133 selects a desired image signal from the decoded image signals input from the decoder 134 and outputs the selected image signal to the driver 131. In this case, the multiplexer 133 can realize so-called multiwindow television, where the screen is divided into a plurality of areas to display a plurality of images in the respective areas, by selectively switching image signals within a display period for one frame.

The display panel controller 132 is a circuit for controlling the operation of the driver 131 on the basis of a control signal input from the CPU 136.

For the basic operation of the display panel, the display panel controller 132 outputs a signal for controlling the operation sequence of the driving power supply (not shown) of the display panel to the driver 131.

For the method of driving the display panel, the display panel controller 132 outputs a signal for controlling the frame display frequency or the scanning method (e.g., interlaced scanning or non-interlaced scanning) to the driver 131.

The display panel controller 132 outputs a control signal associated with adjustment of the image quality including the luminance, contrast, color tone, and sharpness of a display image to the driver 131, as needed.

The driver 131 is a circuit for generating a driving signal to be supplied to the display panel 130. The display panel 130 operates on the basis of an image signal input from the multiplexer 133 and a control signal input from the display panel controller 132.

The functions of the respective components have been described above. The display apparatus having the arrangement shown in FIG. 22 can display image information input from various image information sources on the display panel 130. More specifically, various image signals including TV broadcasting signals are subjected to decoding by the decoder 134, appropriately selected by the multiplexer 133, and input to the driver 131. The display panel controller 132 generates a control signal for controlling the operation of the driver 131 in accordance with the image signal to be displayed. The driver 131 supplies a driving signal to the display panel 310 on the basis of the image signal and the control signal. With this operation, an image is displayed on the display panel 130. The series of operations are integrally controlled by the CPU 136.

This display apparatus not only displays image data selected from image information from the image memory incorporated in the decoder 134 or the image generator 137 but also can perform, for image information to be displayed, image processing including enlargement, reduction, rotation, movement, edge emphasis, thinning, interpolation, color conversion, and aspect ratio conversion, and image editing including synthesizing, deletion, combining, replacement, and pasting. Though not particularly referred to in the description of this example, circuits dedicated to processing and editing of audio information may be arranged, as for image processing and image editing.

The display apparatus can realize functions of various devices, e.g., a TV broadcasting display device, a teleconference terminal device, an image edit device for still and moving images, an office terminal device such as a computer terminal or a wordprocessor, a game machine, and the like. Therefore, the display apparatus has a wide application range for industrial and private use.

FIG. 22 only shows an example of the arrangement of the display apparatus using the display panel in which the electron-emitting devices are used as an electron beam source, but the arrangement of the display apparatus is not limited to this, as a matter of course. For example, of the constituent elements shown in FIG. 22, circuits associated with functions unnecessary for the application purpose can be omitted. Reversely, constituent elements can be added in accordance with the application purpose. When this display apparatus is to be used as a visual telephone, preferably, a TV camera, a microphone, an illumination device, a transmission/reception circuit including a modem may be added.

EXAMPLE 11

An image-forming apparatus was prepared following the same procedures as in Example 10 except that the insulated region formed in step-I had the same shape as in Example 7.

As a result, a satisfactory image display apparatus could be obtained, as in Example 10.

EXAMPLE 12

Figure 23A:
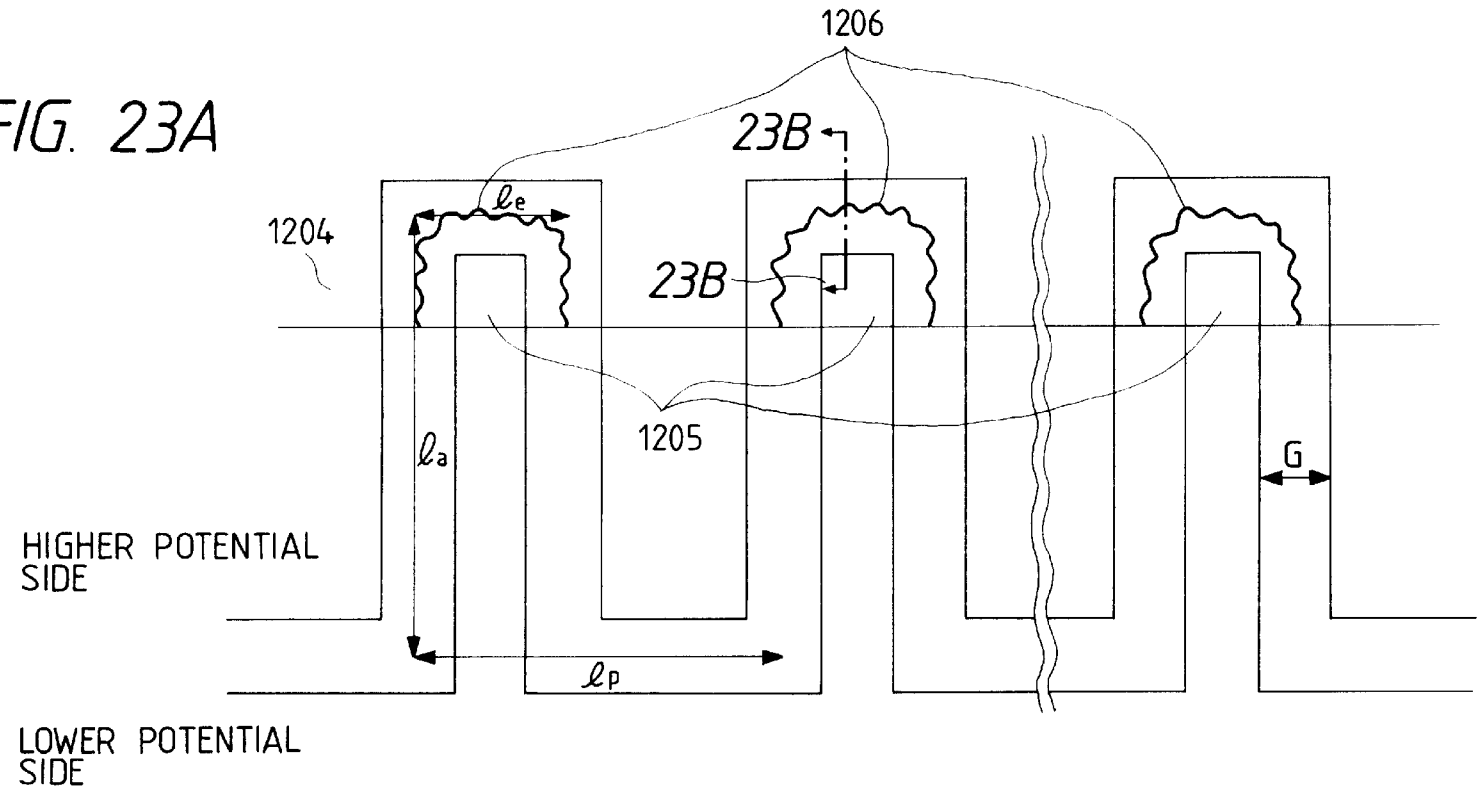
FIGS. 23A and 23B are views for explaining an example of the surface-conduction electron-emitting device of the present invention.
Figure 23B:
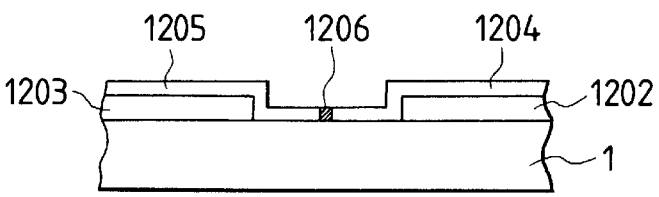

An electron-emitting device of this example has a structure shown in FIGS. 23A and 23B. FIG. 23A is a plan view, and FIG. 23B is a sectional view. The electron-emitting device includes a substrate 1, device electrodes 1202 and 1203, electroconductive films 1204 and 1205, and a fissure 1206, i.e., an electron-emitting portion. An electrode gap width G is uniform. Note that $l_e$, $l_p$, and $l_a$ are defined along the central line of the electrode gap. In this example, the fissure 1206 is formed by energization forming. For this reason, the fissure 1206 is not always formed along the central line. In addition, the fissures 1206 of the respective patterns do not always have the same shape.

A method of manufacturing the electron-emitting device of this example will be described with reference to FIGS. 24A to 24C and FIGS. 14A to 14C. The manufacturing method is basically the same as that of the prior art. Points different from the prior art will be described below in detail.

Step-a

Figure 24A:
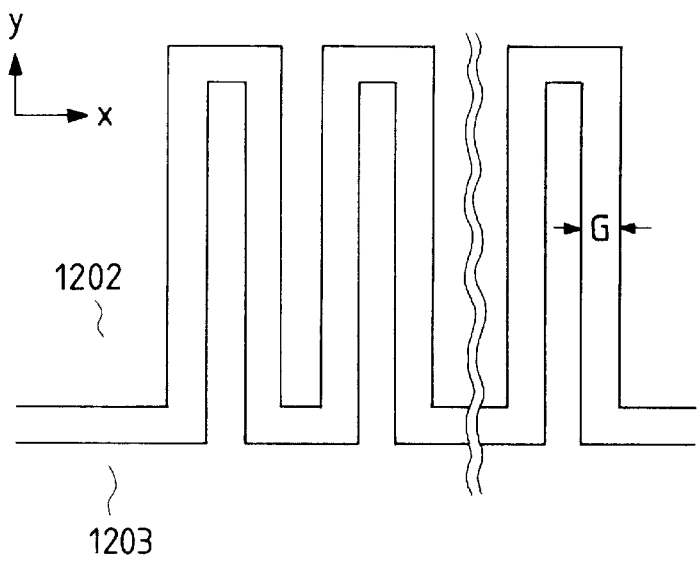
FIGS. 24A, 24B and 24C are views for explaining an example of the method of manufacturing the surface-conduction electron-emitting device of the present invention.

The device electrodes 1202 and 1203 having a shape shown in FIG. 24A were formed from an Ni (100 nm)/Ti (5 nm) film on the substrate 1 consisting of a silicon oxide film (0.5 $\mu$m)/soda-lime glass by lift-off. In this example, $l_e$ was 10 $\mu$m, $l_p$ was 20 $\mu$m, $l_a$ was 50 $\mu$m, and G was 5 $\mu$m.

Step-b and Step-c

Figure 24B:
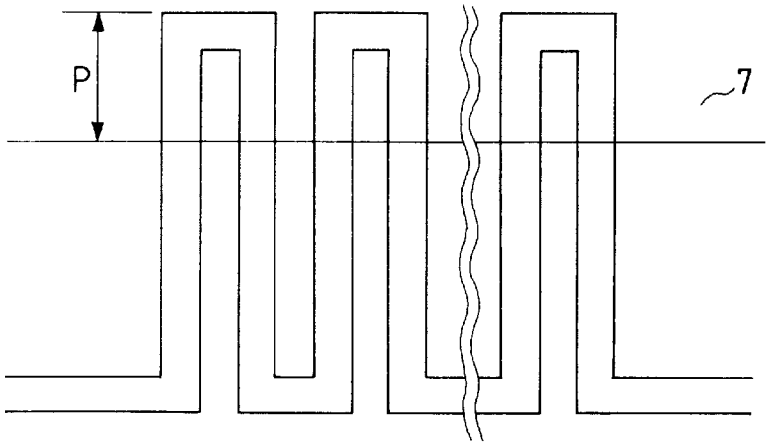

An electroconductive film 7 having a shape shown in FIG. 24B and formed at a position shown in FIG. 24B was formed from a fine Pd oxide particle film (10 nm) by the same method as in the prior art. In this example, the average value of a distance P between the edge of the electroconductive film 7 and the edge of the device electrode 1202 was about 17.5 $\mu$m.

Step-d

Figure 24C:
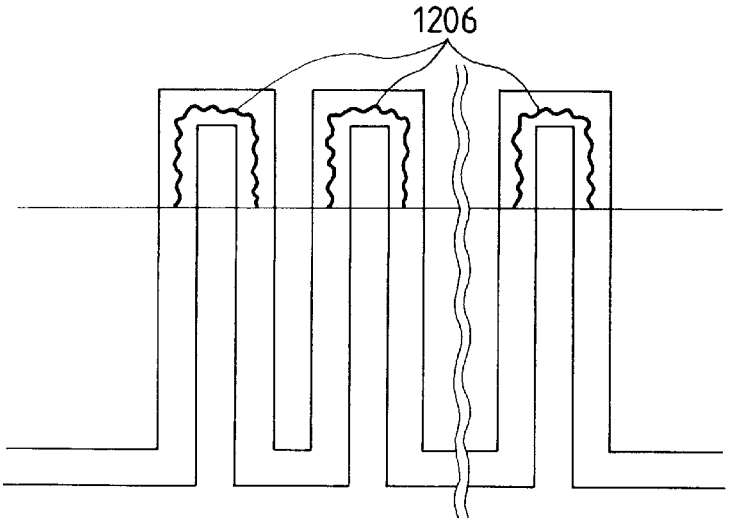

The same method (energization forming) as in the prior art was performed to form the fissure 1206 at part of the electroconductive film 7, as shown in FIG. 24C.

In this example, a triangular pulse was used. A pulse width T1 of the voltage waveform was 1 msec, a pulse interval T2 was 10 msec, and the pulse height was gradually raised every 0.1-V step, thereby performing energization forming. The voltage at the end of the energization forming was 5 V.

Step-e

By the same method (activation processing) as in the prior art, a device current $I_f$ and an emission current $I_e$ which were zero before activation processing largely changed and increased so that the electron-emitting portion was formed in the fissure 1206.

In this example, a rectangular wave was used. The pulse width T1 of the voltage waveform was 1 msec, the pulse interval T2 was 10 msec, and the peak value (peak voltage in activation processing) of the rectangular wave was 15 V. Activation processing was performed in a vacuum atmosphere at about $1.3\times10^{-1}$ Pa, which was obtained by evacuating the apparatus by a rotary pump, for 60 minutes.

The electron-emitting characteristics of the device prepared by the above processes were measured by the measuring/evaluating apparatus having the arrangement shown in FIG. 16. In this example, the distance between the attracting electrode and the electron-emitting device was 4 mm, the potential of the attracting electrode was 1 kV, and the degree of vacuum in the vacuum unit in measuring the electron-emitting characteristics was $1.3\times10^{-4}$ Pa.

Figure 25:
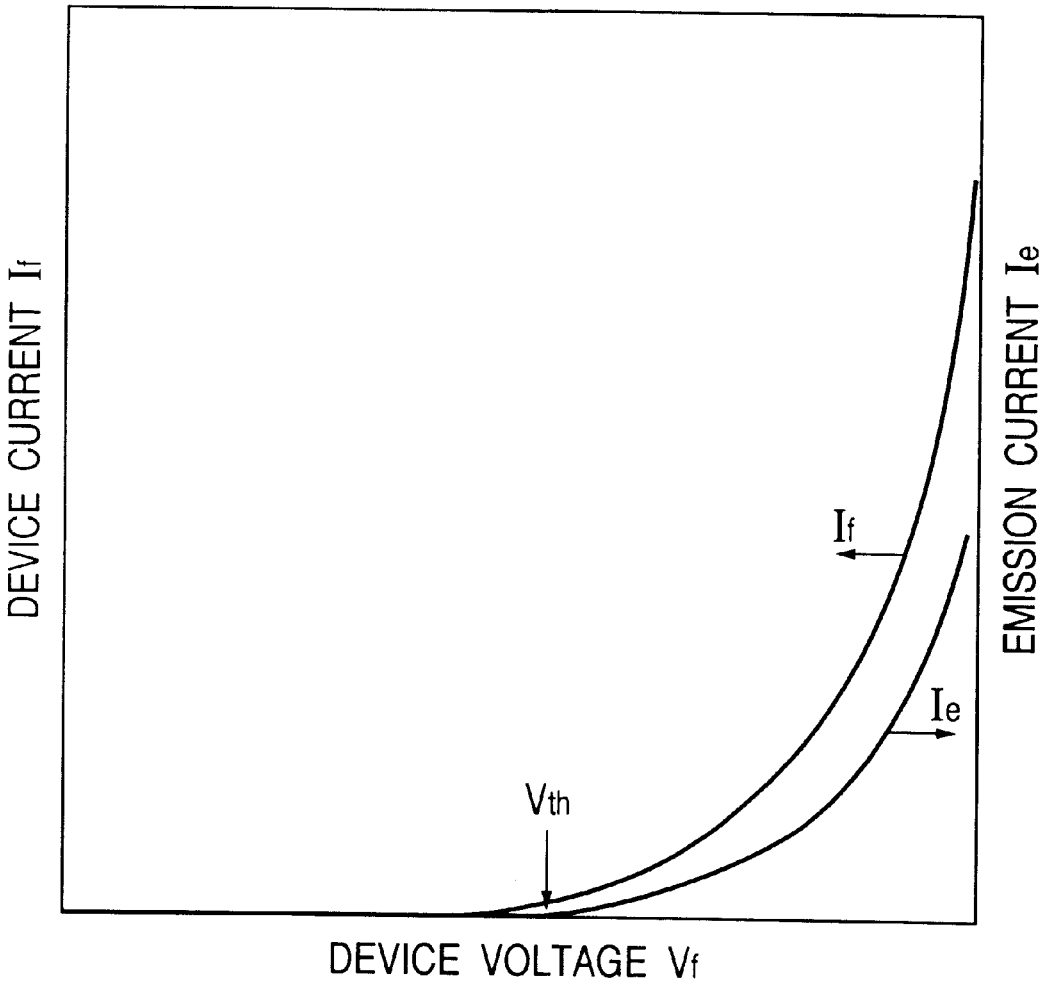
FIG. 25 is a graph showing the current characteristics of the electron-emitting apparatus using the surface-conduction electron-emitting device of the present invention.

Using this measuring/evaluating apparatus, a device voltage was applied across the device electrodes 1202 and 1203, and the device current $I_f$ and the emission current $I_e$ flowing at that time were measured. The obtained current vs. voltage characteristics are shown in FIG. 25. In this device, the emission current $I_e$ abruptly increased at a device voltage of about 7 V. At a device voltage of 14 V, the device current $I_f$ was 1.2 mA, the emission current $I_e$ was 3.6 $\mu$A, and the electron-emitting efficiency $\eta$, i.e., $I_e/I_f(\%)$ was 0.3%.

This electron-emitting device exhibits the same electron-emitting characteristics as in the prior art. Therefore, as same as Example 10, when a lot of electron-emitting devices are arrayed in a matrix, an image display apparatus can be constituted.

The resultant image display apparatus has the characteristics of the electron-emitting apparatus of the present invention, and therefore, a higher efficiency than that of the conventional electron-emitting apparatus.

EXAMPLE 13

A electron-emitting device was prepared following the same procedures as in Example 12 except that step-b and step-c in Example 12 were changed to step-b' and step-c' below.

Step-b'

Fourteen wt % of an aqueous dimethyl sulfoxide solution were prepared. Palladium acetate was dissolved into this aqueous solution to obtain palladium at 0.4 wt %, thereby obtaining a dark red solution.

Step-c'

Figure 26:
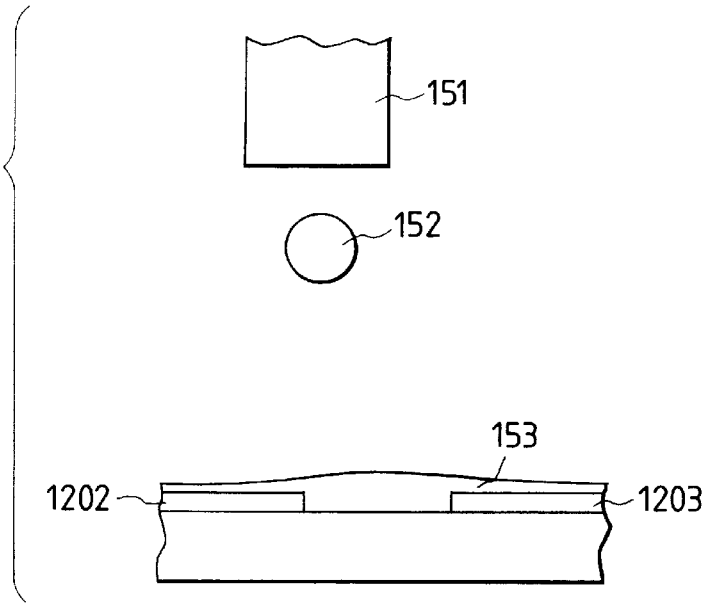
FIGS. 26 and 27 are views for explaining an example of the method of manufacturing the surface-conduction electron-emitting device of the present invention.
Figure 27:
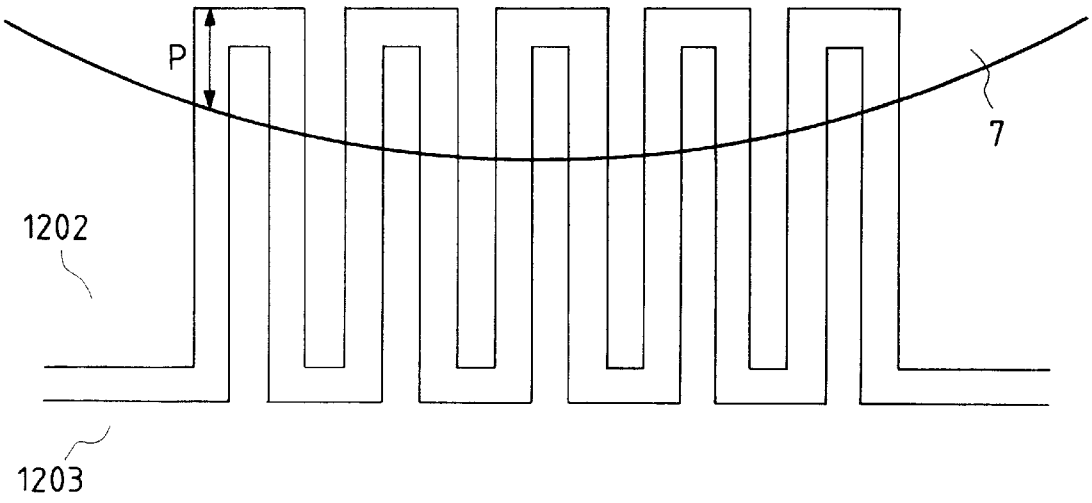

An ink-jet apparatus 151 of a bubble jet type was used to apply droplets 152 of the dark red solution to a substrate 1 on which device electrodes 1202 and 1203 were formed such that the droplets were applied across part of the device electrodes 1202 and 1203 (FIG. 26). A droplet which had been applied to the substrate 1 is represented by 153. The resultant structure was dried at 80° C. for two minutes. The resultant structure was baked at 350° C. for 12 minutes to form an electroconductive film 7 mainly containing palladium oxide (FIG. 27). In this example, the average value of a distance P between the edge of the electroconductive film 7 and the edge of the device electrode 1202 was 17.5 μm.

The electron-emitting characteristics were evaluated by the same method as in Example 12. At a device voltage of 14 V, a device current $I_f$ was 1.0 mA, an emission current $I_e$ was 2.8 μA, and an electron-emitting efficiency η, i.e., $I_e/I_f$ (%) was 0.28%.

EXAMPLE 14

An electron-emitting device was prepared following the same procedures as in Example 12 except that $l_e$ was 5 μm, $l_p$ was 20 μm, $l_a$ was 50 μm.

The electron-emitting characteristics were evaluated by the same method as in Example 12. At a device voltage of 14 V, a device current $I_f$ was 1.2 mA, an emission current $I_e$ was 6.0 μA, and an electron-emitting efficiency η, i.e., $I_e/I_f$ (%) was 0.50%.

EXAMPLE 15

An electron-emitting device was prepared following the same procedures as in Example 13 except that $l_e$ was 5 μm, $l_p$ was 20 μm, $l_a$ was 50 μm.

The electron-emitting characteristics were evaluated by the same method as in Example 12. At a device voltage of 14 V, a device current $I_f$ was 1.0 mA, an emission current $I_e$ was 4.5 μA, and an electron-emitting efficiency η, i.e., $I_e/I_f$ (%) was 0.45%.

EXAMPLE 16

Figure 28A:
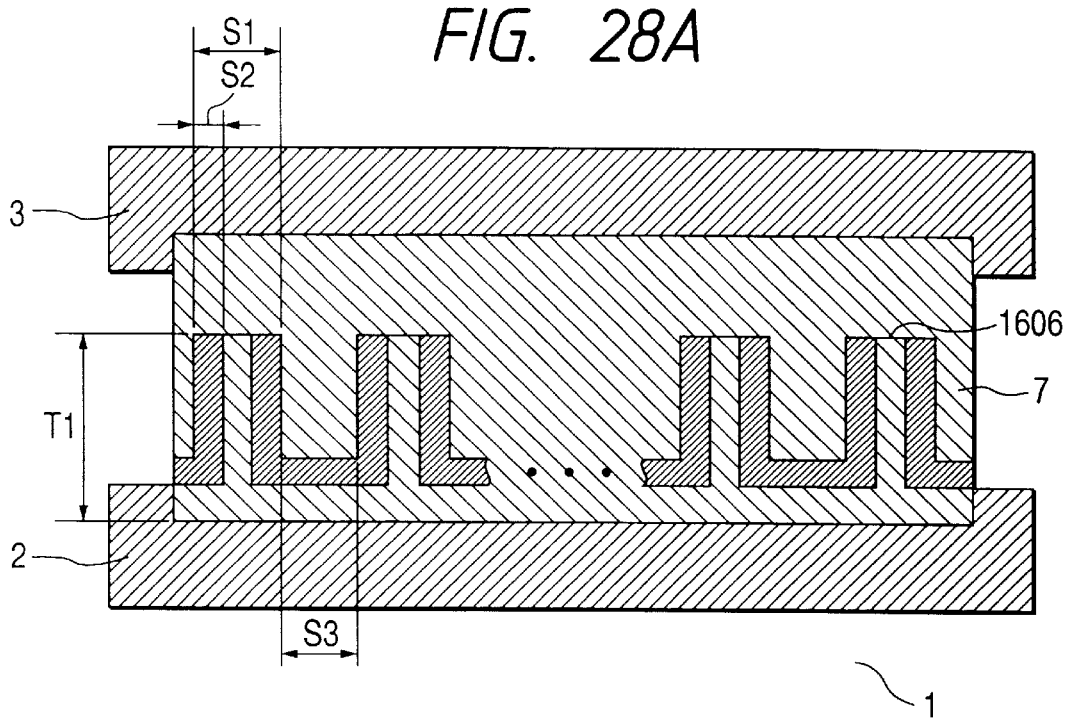
FIGS. 28A and 28B are views for explaining examples of the surface-conduction electron-emitting device of the present invention.
Figure 28B:
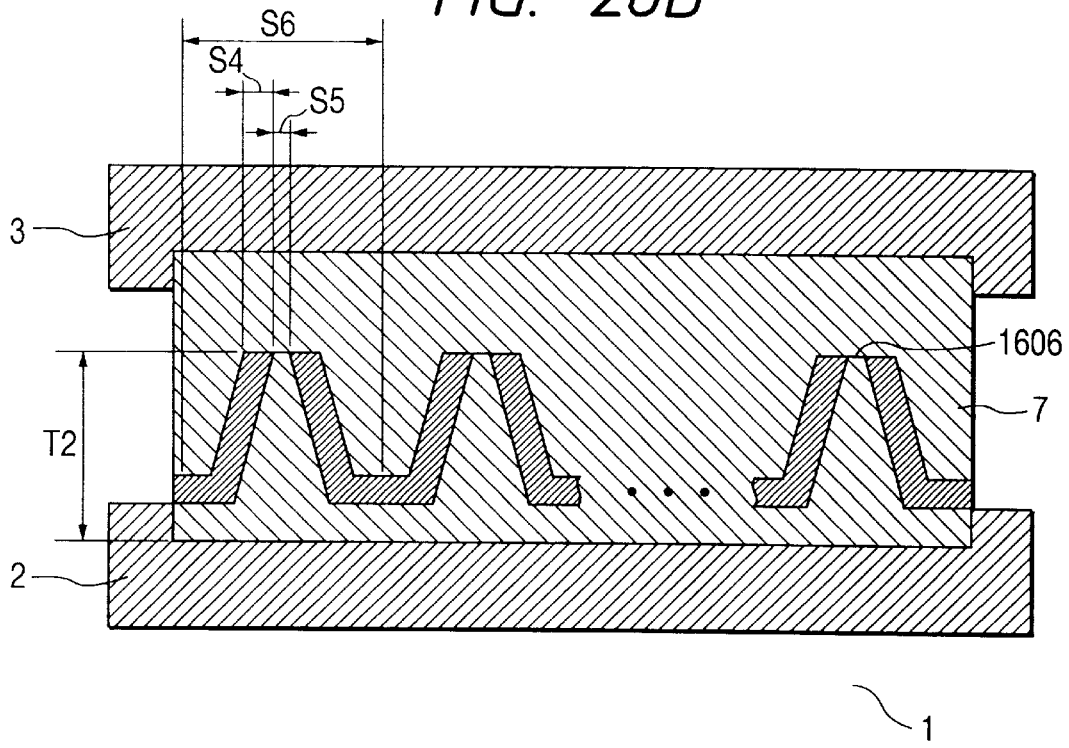

An electron-emitting device of this example has the same structure as in FIG. 28A. The electron-emitting device includes a substrate 1, device electrodes 2 and 3, an electroconductive film 7, and a fissure 1606, i.e., an electron-emitting portion. Note that definition is made such that $l_e$=S1−2S2, $l_p$=S1 +S3, and $l_a$=T1. In this example, the fissure 1606 is formed by energization forming, as will be described later. For this reason, the fissure 1606 is not always formed as a linear fissure, and the fissures 1606 of the respective patterns do not always have the same shape.

A method of manufacturing the electron-emitting device of this example will be described with reference to FIGS. 14A to 14C and FIG. 28.

Step-(1)

A Ti film having a thickness of 5 nm and a Pt film having a thickness of 30 nm were sequentially formed by vacuum deposition on the silica glass substrate 1 cleaned with a neutral detergent, pure water, and an organic solvent. A photoresist (AZ1370; available from Hoechst) was applied and baked to form a resist layer. Exposure and development were performed using a photomask to form the resist pattern of the device electrodes 2 and 3. The unnecessary portions of the Pi/Ti film were removed by wet etching. Finally, the resist pattern was removed by an organic solvent to form the device electrodes 2 and 3. An interval L1 between the device electrodes was 10 μm, and an electrode length W2 was 100 μm (FIG. 14A).

Step-(2)

A Cr film (not shown) having a thickness of 50 nm was deposited by vacuum deposition. An opening portion conforming to an electroconductive film is formed by the conventional photolithography to form a Cr mask.

Palladium acetate monoethanolamine (to be referred to as PAME hereinafter) was rotatably applied by a spinner. The resultant structure was heated and baked in the atmosphere at 310° C. to form a thin film formed of fine particles whose principal ingredient was palladium oxide (PdO). The Cr mask was removed by wet etching and lifted off to form the electroconductive film 7 having a desired pattern. A resistance value Rs of the electroconductive film was $4.0\times10^{-4}$ Ω/□ (FIG. 14B).

Step-(3)

The device was set on a stage with X- and Y-driving pulse motors. The ray of an Ar ion laser with an excitation wavelength of 514.5 nm was irradiated on the device such that the intensity on the electroconductive film became 10 mW, and the X-Y stage was moved to remove the metal Pd portions, thereby forming an insulated region having the shape shown in FIG. 28A. As for the width of the insulated region, S1 was 5 μm, S2 was 1 μm, S3 was 5 μm, and T1 was 7 μm. Therefore, it is defined that $l_e$ is 3 μm, $l_p$ is 10 μm, and $l_a$ is 7 μm.

Step-(4)

The device was set in the measuring/evaluating apparatus shown in FIG. 16. The apparatus was evacuated by a vacuum pump to a pressure of $2.0\times10^{-3}$ Pa. A pulse voltage was applied from a power supply 10 for applying a device voltage $V_f$ to the device across the device electrodes 2 and 3 to perform an electrification process (energization forming), thereby forming the fissure 1606.

When a device current $I_f$ became extremely small, application of the voltage was ended. The device was left in a hydrogen atmosphere for one hour to perform the reduction treatment such that the electroconductive film 7 contained only the metal Pd.

Step-(5)

A vacuum unit 16 was evacuated by a vacuum pump 15 again to a pressure of $2.0\times10^{-3}$ Pa. Thereafter, a pulse voltage was applied from the power supply 10 for applying the device voltage $V_f$ to the device across the device electrodes 2 and 3 to perform activation processing while measuring the device current $I_f$. The device current $I_f$ which was substantially zero before activation processing largely changed and increased. The device current $I_f$ was almost saturated for about 30 minutes, and the processing was ended. At this time, a rectangular pulse having a pulse width Ti of 0.5 msec, a pulse interval T2 of 10 msec, and a pulse height of 16 V was used.

Step-(6)

The exhaust unit was switched to the ion pump to evacuate the vacuum unit 16 while heating the entire vacuum unit 16 to about 200° C. The pressure lowered to 1.3×10−7 Pa after 24 hours. To grasp the characteristics of the surface-conduction electron-emitting device manufactured by the above processes, the electron-emitting characteristics of the device were measured using the evaluating apparatus shown in FIG. 16.

Comparative Example 4

An electron-emitting portion was formed by performing the same processes as in step-(1) and step-(2) and then step-(4) to step-(6) of Example 16 while omitting step-(3).

Step-(7)

To grasp the characteristics of the surface-conduction electron-emitting devices manufactured in Example 16 and Comparative Example 4, the electron-emitting characteristics were measured using the evaluating apparatus shown in FIG. 16. Each electron-emitting device and an attracting electrode 12 were set in a vacuum unit 16. The vacuum unit has equipment (not shown) such as an exhaust pump and a vacuum system necessary for the vacuum unit to form a high vacuum so that measurement/evaluation of the device can be performed in a desired vacuum atmosphere. A rectangular pulse voltage having a pulse peak value of 15 V was applied to the side of the device electrode 3. The applied pulse had a pulse width T1 of 0.1 msec and a pulse interval T2 of 25 msec. A distance H between the device and the attracting electrode was 4 mm, the potential of the attracting electrode was 1 kV, and the pressure in measuring the electron-emitting characteristics was $2.0\times10^{-7}$ Pa. Table 5 shows the results. Note that η represents the electron-emitting efficiency ($I_e/I_f$).

TABLE 5

| | $I_f$ (mA) | $I_e$ (μA) | η (%) |
|---|---|---|---|
| Example 16 | 1.1 | 5.1 | 0.46 |
| Comparative Example 4 | 2.5 | 2.5 | 0.10 |

According to this example, it is confirmed that a device having a high efficiency can be easily manufactured by applying the present invention.

EXAMPLE 17

First, the same processes as in step-(1) and step-(2) of Example 16 were performed. Thereafter, the following processes were performed.

Step-(3)

The device was set in the same apparatus as in step-(3) of Example 16 to form an insulated region. The insulated region has the shape shown in FIG. 28B.

As for the width of the insulated region, S4 was 1 μm, S5 was 5 μm, S6 was 10 μm, and T2 was 7 μm.

Step-(4)

The device was set in the vacuum processing unit shown in FIG. 16. The same energization forming and reproduction processing as in step-(4) of Example 16 were performed to form a fissure 1606.

The vacuum unit 16 was temporarily evacuated to a high vacuum by a vacuum pump 15, acetone was supplied, and the pressure was set to be $2.5\times10^{-1}$ Pa. A pulse voltage was applied across device electrodes 2 and 3 to perform activation processing. At this time, a rectangular pulse was used. A pulse width T1 was 1 msec, and a pulse interval T2 was 10 msec. The pulse height was gradually increased from 10 V to 18 V at a rate of 0.2 V/min.

Step-(5)

Supply of acetone was stopped. The vacuum unit 16 was evacuated by the vacuum unit 15 while heating the entire vacuum unit 16 to about 200° C. The pressure lowered to $1.3\times10^{-7}$ Pa after 24 hours. To grasp the characteristics of the surface-conduction electron-emitting device prepared in this example, the electron-emitting characteristics were measured using the evaluating apparatus shown in FIG. 16, as in Example 1. The pulse voltage applied to the device was the same as in Example 1. The pressure in measuring the electron-emitting characteristics was $2.0\times10^{-7}$ Pa.

In the device prepared in this example, an emission current $I_e$ abruptly increased at a device voltage of about 10 V. At a device voltage of 15 V, a device current $I_f$ was 1.1 mA, the emission current $I_e$ was 6.4 μA, and an electron-emitting efficiency η was 0.58%.

EXAMPLE 18

The same processes as in Example 16 were performed except that a focused ion beam was used in step-(3) of Example 16. Finally, the electron-emitting characteristics were measured using the evaluating apparatus shown in FIG. 16 at a pressure $2.0\times10^{-7}$ Pa under the same conditions as in Example 16. At a device voltage of 15 V, a device current $I_f$ was 1.0 mA, an emission current $I_e$ was 5.1 μA, and an electron-emitting efficiency η was 0.51%.

EXAMPLE 19

The same processes as in Example 16 were performed except that an Nd:YAG laser was used in step-(3) of Example 16. Finally, the electron-emitting characteristics were measured using the evaluating apparatus shown in FIG. 16 at a pressure of $2.0\times10^{-7}$ Pa under the same conditions as in Example 16. At a device voltage of 15 V, a device current $I_f$ was 1.3 mA, an emission current $I_e$ was 5.1 μA, and an electron-emitting efficiency 72 was 0.40%.

EXAMPLE 20

In step-(2) of Example 16, the conventional photolithography was applied to simultaneously form an electroconductive film 7 and an insulated region such that the pattern shown in FIG. 15A was obtained after lift-off. The remaining processes were the same as those in Example 16. Finally, the electron-emitting characteristics were measured using the evaluating apparatus shown in FIG. 16 at a pressure of $2.0\times10^{-7}$ Pa under the same conditions as in Example 16. At a device voltage of 15 V, a device current $I_f$ was 1.2 mA, an emission current $I_e$ was 5.0 μA, and an electron-emitting efficiency η was 0.41%.

According to this example, since the electroconductive film and the insulated region were simultaneously formed, the manufacturing method of the present invention could be quickly applied, and the surface-conduction electron-emitting device could be uniformly manufactured.

EXAMPLE 21

An image-forming apparatus was prepared following the same procedures as in Example 10 except that step-I of Example 10 was changed to step-I' below.

Step-I'

The electron source substrate was set on a stage with X- and Y-driving pulse motors. An oscillation line of an Ar ion laser with an excitation wavelength of 514.5 nm was irradiated on the substrate such that the intensity on the electroconductive film became 10 mW, and the X-Y stage was moved to remove the metal Pd portions, thereby forming an insulated region having the same shape as in Example 17.

The device was set in the measuring/evaluating apparatus shown in FIG. 16. The apparatus was evacuated by a vacuum pump to a pressure of $2.0\times10^{-3}$ Pa. A pulse voltage was applied from a power supply 10 for applying a device voltage $V_f$ to the device across the device electrodes 2 and 3 to perform an electrification process (energization forming), thereby forming a fissure 6.

When a device current $I_f$ completely became zero, application of the voltage was ended. The device was left in a hydrogen atmosphere for one hour to perform the reduction treatment such that an electroconductive film 7 contained only the metal Pd.

As a result, a satisfactory image-forming apparatus could be obtained, as in Example 10.

EXAMPLE 22

In this example, a case wherein a continuous electron-emitting portion is formed in the entire insulated region.

In this example, an electron-emitting device was prepared following the same procedures as in Example 1 except that the insulated region formed by the focused ion beam processing apparatus in step-c had the shape shown in FIG. 15A, and the width of the insulated region was adjusted to be 40 nm at all portions (portions indicated by thick and thin lines). Note that $l_e$ was 5 μm, $l_p$ was 10 μm, and $l_a$ was 10 μm.

The electron-emitting characteristics of the device of this example were measured by the apparatus shown in FIG. 16. The voltage applied to the device at this time was a rectangular pulse having a pulse width T1 of 100 μsec, a pulse interval T2 of 10 msec, and a pulse peak value of 15 V. A distance H between the device and the attracting electrode was 4 mm, and the potential of the attracting electrode was 1 kV. As a result, a device current $I_f$ was 2.5 mA, an emission current $I_e$ was 5.2 μA, and an electron-emitting efficiency η was 0.21%.

As has been described above, according to the present invention, an electron-emitting device having a high electron-emitting efficiency and stably controlled characteristics is provided. In addition, a high-quality image can be obtained by the image-forming apparatus using the electron source in which a number of devices are integrated.

What is claimed is:

1. An electron-emitting apparatus constituted by an electron-emitting device having an electroconductive film which includes electron-emitting portions, and an electrode for attracting electrons, wherein an electrically insulated elongated region is formed in said electroconductive film to divide said electroconductive film into a higher potential side and a lower potential side, said insulated region having a substantially periodical shape formed of plural portions projecting to the higher potential side and plural portions projecting to the lower potential side, and continuous electron-emitting portions are present at at least part of said portion projecting to the higher potential side in one period of said insulated region.

2. An apparatus according to claim 1, wherein a deposit comprising at least one of carbon and a carbon compound is at least on the electron-emitting portions.

3. An apparatus according to claim 1, wherein a length $l_e$ of said electron-emitting portion included in one period of said insulated region, a period $l_p$ of said insulated region, and a zigzag distance $l_a$ between said portion projecting to the higher potential side and said portion projecting to the lower potential side in said insulated region fall within the following ranges:

$5\ \mu m \leqq l_p \leqq 80\ \mu m$ $1\ \mu m \leqq l_e \leqq 40\ \mu m$ $1\ \mu m \leqq l_a \leqq 100\ \mu m$.

4. An apparatus according to claim 1, wherein said electron-emitting device further comprises a first electrode and a second electrode, wherein said first electrode is connected to said higher potential side and said second electrode is connected to said lower potential side.

5. An apparatus according to claim 4, wherein a region sandwiched by said electrodes has a periodical shape formed of portions projecting to the first electrode and portions projecting to the second electrode.

6. An apparatus according to claim 1, wherein said electron-emitting device is a surface-conduction electron-emitting device.

7. An electron-emitting apparatus constituted by an electron-emitting device having an electroconductive film which includes electron-emitting portions, and an electrode for attracting electrons, wherein an electrically insulated elongated region is formed in said electroconductive film to divide said electroconductive film into a higher potential side and a lower potential side, said insulated region having a substantially periodical shape formed of portions projecting to the higher potential side and portions projecting to the lower potential side, a continuous linear electron-emitting portion is formed in said insulated region, and a length $l_e$ of said portion projecting to the higher potential side included in one period of said insulated region, a period $l_p$ of said insulated region, and a zigzag distance $l_a$ between said portion projecting to the higher potential side and said portion projecting to the lower potential side in said insulated region fall within the following ranges:

$5\ \mu m \leqq l_p \leqq 80\ \mu m$ $1\ \mu m \leqq l_e \leqq 20\ \mu m$ $5\ \mu m \leqq l_a \leqq 100\ \mu m$ and a potential difference $V_a$ between the attracting electrode and the electroconductive film of lower potential side and a distance between the attracting electrode and the electron-emitting device satisfy the following relationship:

$V_a/H \leqq 0.5\times10^6$ [V/m].

8. An apparatus according to claim 7, wherein said electron-emitting device further comprises a pair of opposing device electrodes, a portion on the higher potential side and a portion on the lower potential side of said electroconductive film are electrically connected to said device electrodes, respectively, and a region sandwiched by said device electrodes has a periodical shape formed of portions projecting to the higher potential side and portions projecting to the lower potential side, and said electroconductive film exists in said region sandwiched by said device electrodes.

9. An apparatus according to claim 7, wherein at least one of carbon and a carbon compound is present at least on said electron-emitting portion.

10. An apparatus according to claim 7, wherein said electron-emitting device is a surface-conduction electron-emitting device.

* * * * *